US009663998B2

(12) United States Patent
Poppe

(10) Patent No.: US 9,663,998 B2
(45) Date of Patent: May 30, 2017

(54) SYSTEM AND METHOD FOR COUPLING A WELLBORE SURVEY TOOL TO A RETRIEVABLE SENSOR MODULE

(71) Applicant: Gyrodata, Incorporated, Houston, TX (US)

(72) Inventor: William David Poppe, Houston, TX (US)

(73) Assignee: Gyrodata, Incorporated, Houston, TX (US)

( * ) Notice: Subject to any disclaimer, the term of this patent is extended or adjusted under 35 U.S.C. 154(b) by 377 days.

(21) Appl. No.: 14/329,828

(22) Filed: Jul. 11, 2014

(65) Prior Publication Data

US 2016/0010399 A1 Jan. 14, 2016

(51) Int. Cl.

| | |
|---|---|
| ***E21B 17/046*** | (2006.01) |
| ***E21B 47/022*** | (2012.01) |
| ***G01C 19/34*** | (2006.01) |
| ***E21B 17/02*** | (2006.01) |

(52) U.S. Cl.

CPC ..... *E21B 17/046* (2013.01); *E21B 17/021* (2013.01)

(58) Field of Classification Search

CPC ..... E21B 17/021; E21B 17/046; E21B 23/00; E21B 23/03; E21B 43/119; E21B 47/024; E21B 47/022; G01C 19/34

See application file for complete search history.

(56) References Cited

U.S. PATENT DOCUMENTS

| | | | | |
|---|---|---|---|---|
| 2,679,898 | A * | 6/1954 | Forsyth | E21B 43/119 175/4.51 |
| 3,052,309 | A * | 9/1962 | Eastman | E21B 7/065 166/117.5 |
| 5,704,425 | A * | 1/1998 | Divis | E21B 23/02 166/191 |
| 5,836,387 | A * | 11/1998 | Carter | E21B 7/061 166/217 |
| 6,260,623 | B1 * | 7/2001 | Schick | E21B 29/06 166/313 |
| 6,298,915 | B1 * | 10/2001 | George | E21B 43/119 166/255.2 |
| 7,334,650 | B2 * | 2/2008 | Giroux | B05B 1/00 166/380 |
| 7,823,660 | B2 * | 11/2010 | Giroux | B05B 1/00 175/61 |
| 8,025,105 | B2 * | 9/2011 | Templeton | E21B 7/061 166/117.5 |
| 9,334,701 | B1 * | 5/2016 | Carr | E21B 23/03 |
| 2011/0011646 | A1 * | 1/2011 | Giroux | E21B 7/06 175/61 |
| 2016/0010399 | A1 * | 1/2016 | Poppe | E21B 17/021 166/380 |
| 2016/0245068 | A1 * | 8/2016 | David Cramer | E21B 47/01 |

* cited by examiner

*Primary Examiner* — Daniel P Stephenson
(74) *Attorney, Agent, or Firm* — Pramudji Law Group PLLC; Ari Pramudji

(57) ABSTRACT

Systems and methods for the down-hole automatic mechanical coupling and alignment of a first sensor module and a second sensor module are provided. A mating element of a first sensor module includes a sheath with a first cam and a shroud surrounding the first cam. A second mating element of a second sensor module includes a second cam complementary to the first cam. Upon mating, the sheath surrounds at least a portion of the second mating element and the first cam seats against the second cam, with a predetermined axial orientation with respect to each other.

24 Claims, 17 Drawing Sheets

SYSTEM AND METHOD FOR COUPLING A WELLBORE SURVEY TOOL TO A RETRIEVABLE SENSOR MODULE

BACKGROUND

Field of the Application

The present embodiments relate to systems and methods for aligning two portions of a system without user input. More specifically, the present embodiments relate to systems and methods for consistent and reproducible remote down-hole alignment of a first sensor module of a directional drilling system and a second sensor module automatically with a predefined orientation with respect to one another.

Description of the Related Art

Drilling tools can comprise measurement-while-drilling (MWD) sensor modules. In some situations, it becomes advantageous to use both an MWD sensor module and a gyroscope sensor module while drilling the wellbore. It is impractical to raise the entire drill mechanism simply to attach a gyroscope sensor module to the MWD sensor module. However, for the data collected by the MWD sensor module and the gyroscope sensor module to be of optimal use, the two sensor modules are desired to be in a predefined orientation with respect to one another.

SUMMARY

One aspect provided by the disclosure is a system for the down-hole alignment of a mating element and a second mating element. The system comprises a mating element and a second mating element. The mating element comprises a sheath comprising an axis and a first cam. The first cam has a first cam point and a first notch. The mating element further comprises a shroud disposed around the first cam and extending past the first cam point. The second mating element comprises an elongate member, a second cam, and a pin. The second cam is releasably mounted around the elongate member and has a second cam point and a second notch. The pin is releasably disposed through the elongate member and the second cam. The pin has a length greater than an outer diameter of the second cam. The first mating element is configured to mate with the second mating element such that the sheath accepts the elongate member, and the first cam seats against the second cam with a predefined orientation about the axis. The second notch accepts the first cam point and the first notch accepts the second cam point.

Another aspect provided by the disclosure is a method for remotely coupling a first sensor module to a second sensor module of a directional drilling tool within a wellbore. The method comprises lowering the first sensor module into the wellbore. The first sensor module comprises a mating element configured to mate with a second mating element of the directional drilling tool. The mating element comprises a sheath and a shroud. The sheath comprises a first cam and an axis. The shroud is disposed around the first cam, wherein the second mating element comprises a second cam complementary to the first cam. The method further comprises positioning the mating element onto the second mating element such that the sheath surrounds at least a portion of the second mating element and the first cam seats against the second cam with a predefined orientation about the axis.

Another aspect provided by the disclosure is a mating element configured to mate to a second mating element while the mating element and the second mating element are within a wellbore. The mating element comprises a sheath and a shroud. The sheath comprises a first cam and an axis. The shroud is disposed around the first cam. The second mating element comprises a second cam complementary to the first cam, wherein upon mating, the sheath surrounds at least a portion of the second mating element and the first cam seats against the second cam with a predefined orientation about the axis.

DETAILED DESCRIPTION

Figure 1:
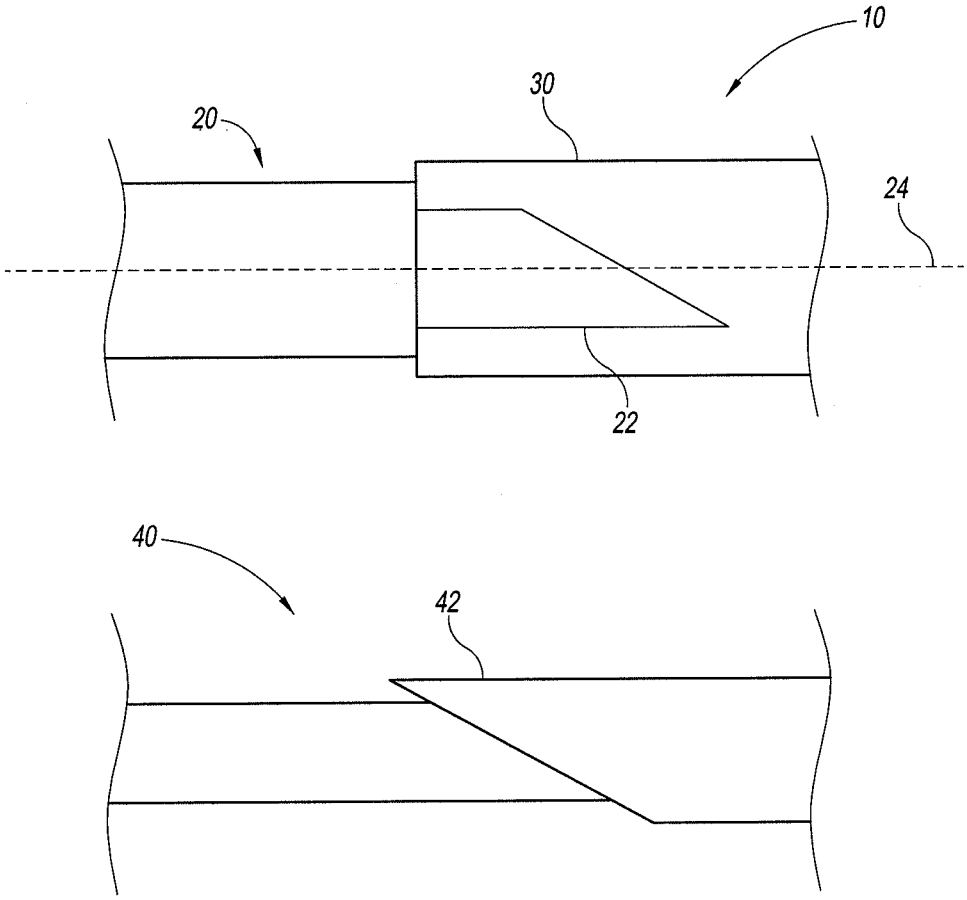
FIG. 1 schematically illustrates a portion of an example mating element and a portion of an example second mating element in accordance with certain embodiments described herein.

Certain embodiments described herein advantageously provide systems and methods for lowering a first sensor module (e.g., a gyroscope sensor module) into a wellbore and onto a second sensor module (e.g., a MWD sensor module of a directional drilling system) to automatically couple and align the first sensor module and the second sensor module in a predetermined orientation to one another. FIG. 1 schematically illustrates a portion of an example mating element 10 and a portion of an example second mating element 40 in accordance with certain embodiments described herein. The mating element 10 comprises a sheath 20 comprising a first cam 22 and an axis 24. The mating element 10 further comprises a shroud 30, disposed around the first cam 22. The mating element 10 is configured to be mechanically coupled to a second mating element 40 while the mating element 10 and the second mating element 40 are within a wellbore. The second mating element 40 comprises a second cam 42 complementary to the first cam 22. Upon mating, the sheath 20 surrounds at least a portion of the second mating element 40 and the first cam 22 seats against the second cam 42 with a predefined orientation about the axis 24.

FIGS. 2A-2C and 3A-3D illustrate various views, of an example sheath 20 in accordance with certain embodiments described herein. The sheath 20 can be configured to be mounted to a first sensor module (e.g., a wireline gyroscope sensor module) and can serve as an alignment tool to automatically and remotely couple the first sensor module to a second sensor module (e.g., measurement-while-drilling or MWD sensor module) within a wellbore and to orient the first sensor module to the second sensor module with a predetermined orientation with respect to one another.

Figure 2A:
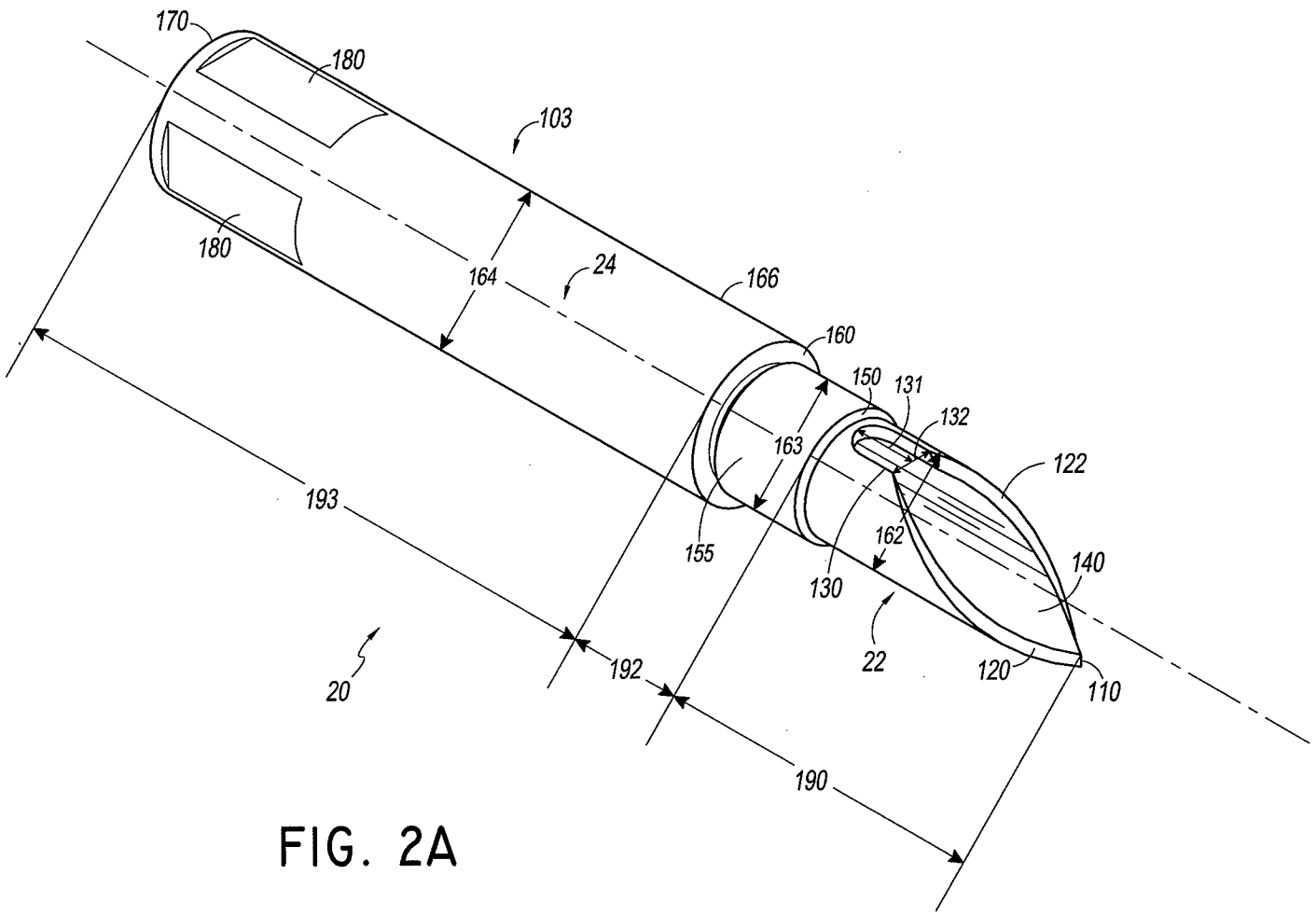
FIG. 2A is a top-biased, front-right three-quarter view of an example sheath in accordance with certain embodiments described herein.
Figure 2B:
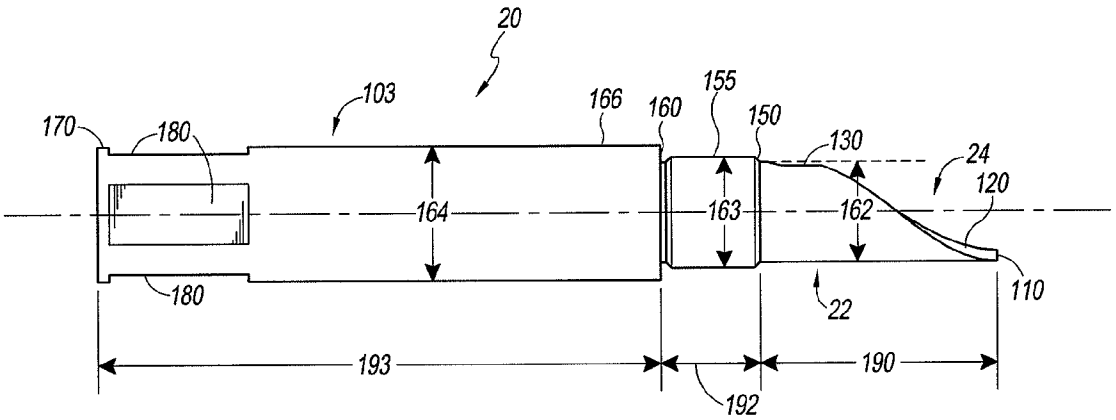
FIG. 2B is a right-side view the example sheath of FIG. 2A.
Figure 2C:
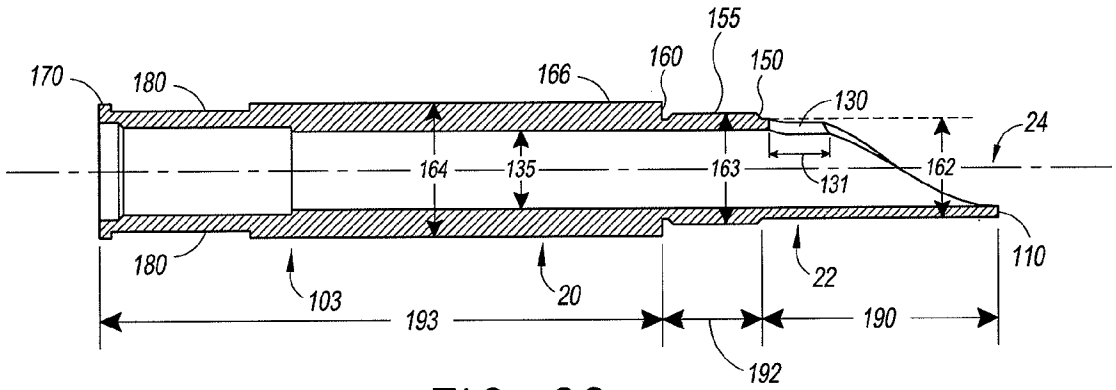
FIG. 2C is a right-side cut-away view of the example sheath of FIG. 2A.

Besides the first cam 22 and the axis 24, the sheath 20 can comprise a body 103, a neck 155 between the first cam 22 and the body 103, and a socket 140, as described more fully below. The first cam 22 is attached to the neck 155 and the neck 155 is attached to the body 103. The first cam 22, neck 155 and body 103 can be coaxial with one another (e.g., extending along the axis 24, as shown in FIGS. 2A-2C), with the socket 140 comprising a cavity having an inner diameter 135 and extending along the length of the sheath 20 (e.g., through the first cam 22, the neck 155, and at least a portion of the body 103), as shown in FIG. 2C.

Figure 3A:
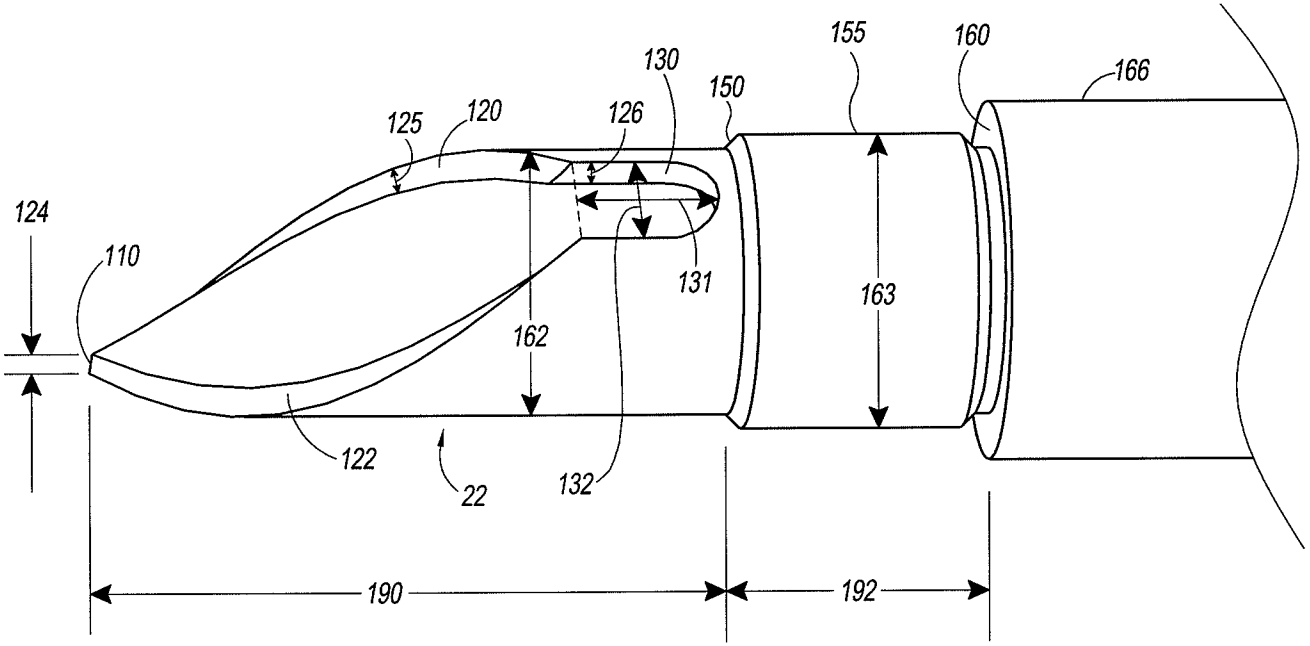
FIG. 3A is a top-biased, left-side view of the first cam of the example sheath of FIG. 2A.
Figure 3B:
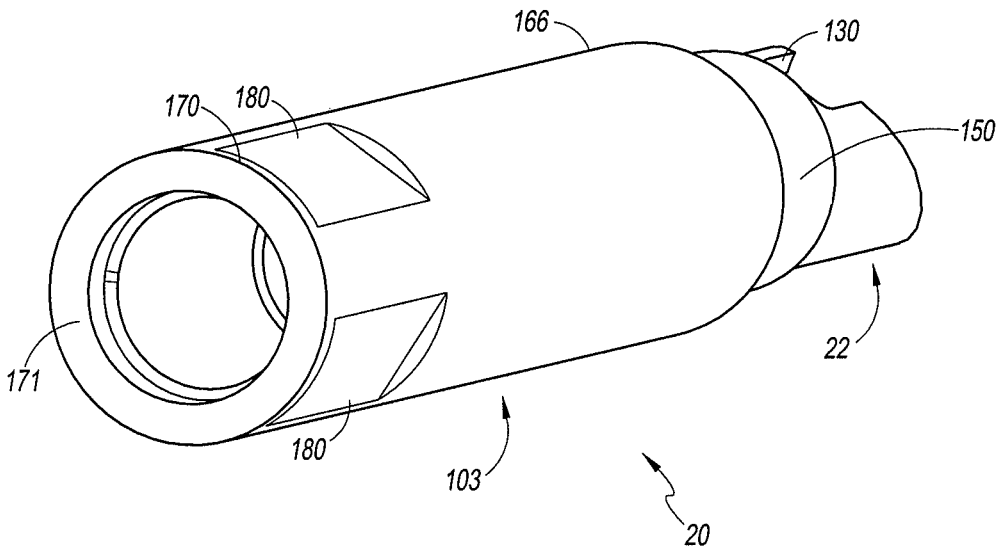
FIG. 3B is a front-biased, rear three-quarter view of the body of the sheath of FIG. 2A.
Figure 3C:
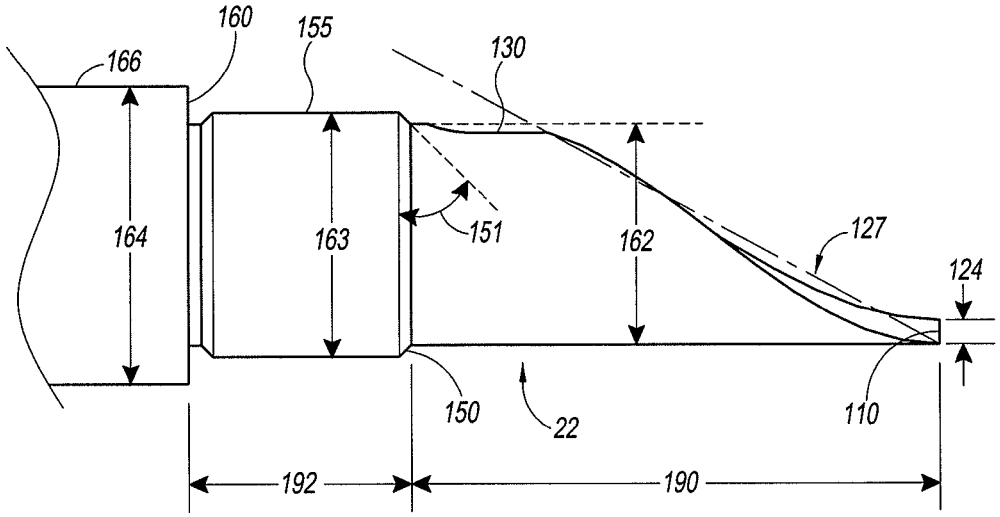
FIG. 3C is an enlarged right-side view the first cam of the example sheath of FIG. 2A.
Figure 3D:
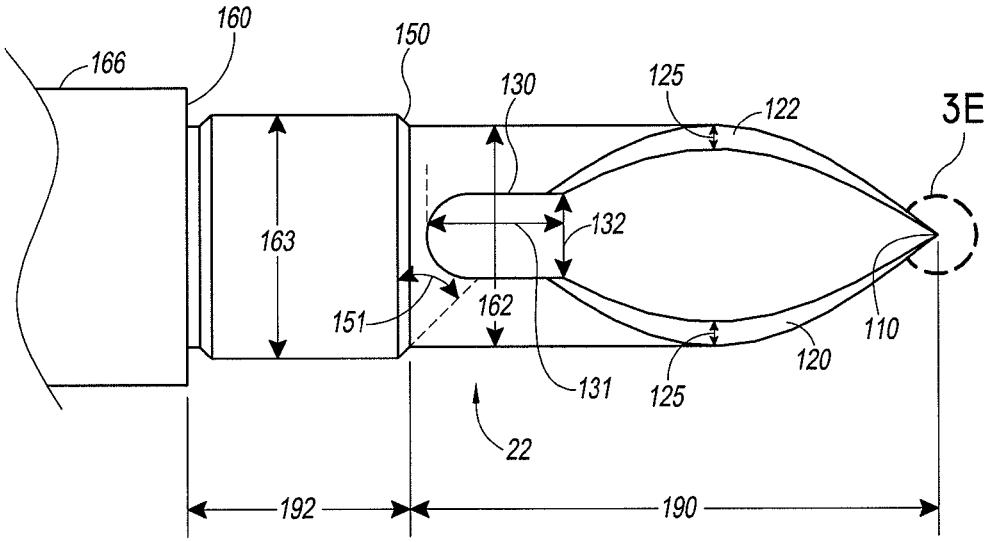
FIG. 3D is an enlarged top-side view of the first cam of the example sheath of FIG. 2A.
Figure 3E:
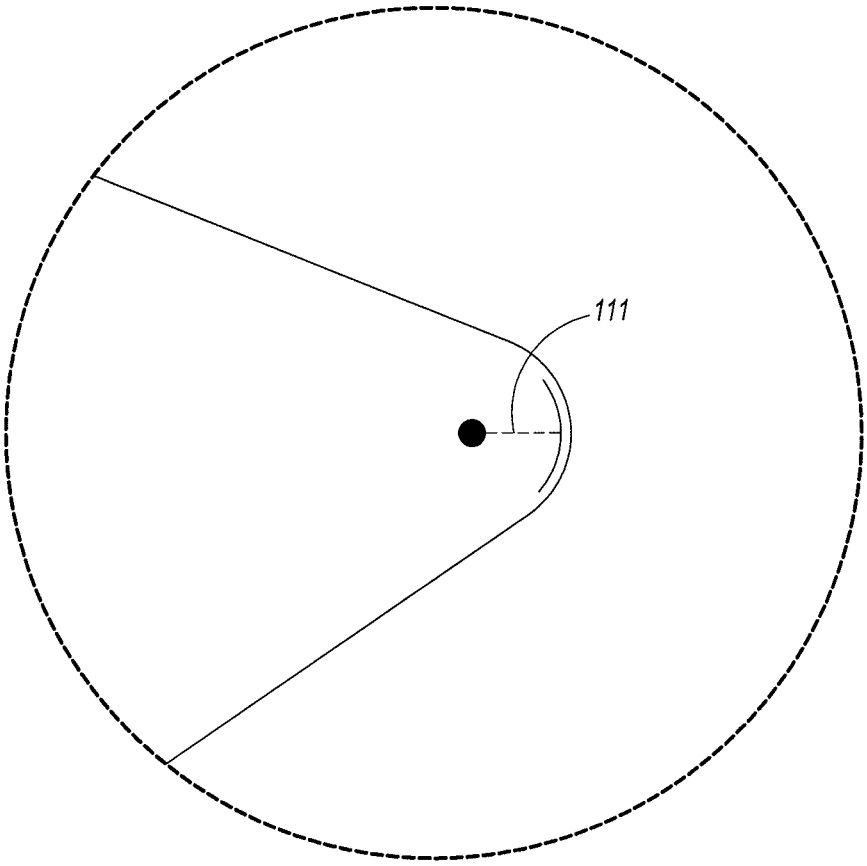
FIG. 3E is a close-up view of the cam point of the first cam of FIG. 3D.

FIGS. 2A-2C, 3A, and 3C-3E illustrate an example first cam 22 in accordance with certain embodiments described herein. As illustrated in FIGS. 3C and 3D, the first cam 22 can have a shape that roughly resembles an obliquely cut pipe. However, the first cam 22 can include a precisely formed shape. The first cam 22 can comprise a cam point 110 at a proximal end of the first cam 22 and having a radius of curvature 111 (e.g., as shown in FIG. 3E) and a thickness 124. In some embodiments, the radius of curvature 111 can be about 0.01 inches. In other embodiments, the radius of curvature 111 can be in the range of about 0.005-0.09 inches, about 0.01-0.06 inches, about 0.005-0.02 inches, or any other radius of curvature that facilitates functioning of the system as disclosed herein. In some embodiments, the thickness 124 can be about 0.14 inches. In other embodiments, the thickness 124 can be in the range of about 0.05-0.25 inches, about 0.10-0.20 inches, or any other thickness that facilitates functioning of the system as disclosed herein.

As can be seen in FIG. 3D, the first cam 22 extends from the cam point 110 into a first shoulder 120 and a second shoulder 122, each having a shoulder thickness 125. In some embodiments, the first shoulder 120 and the second shoulder 122 are bilaterally symmetrical with one another. In some embodiments, as shown in FIGS. 2A-2C and 3A-3E, the first shoulder 120 and the second shoulder 122 each have a surface (e.g., face) configured to mate with corresponding surfaces (e.g., faces) of the shoulders of a second cam, as described more fully below. The surfaces can be substantially flat across the shoulder thickness 125. FIGS. 2A, 3A and 3D show close up views of an example first shoulder 120 and second shoulder 122 having flat faces for which there is substantially no radial curvature across the thicknesses of the first shoulder 120 and the second shoulder 122. For example, each surface can comprise a flat face for which all points to the left and right of a given center point of the shoulder lie on a single geometric line perpendicular to the longitudinal axis of the shoulder. In other embodiments, the first shoulder 120 and the second shoulder 122 have rounded faces. In some embodiments, the first shoulder 120 and the second shoulder 122 meet at their respective bases in a pointed fashion, such that the bases of the first shoulder 120 and the second shoulder 122 form a "negative" of the cam point 110. In other embodiments, as shown in FIG. 3D, the first cam 22 further comprises a notch 130 between the first shoulder 120 and the second shoulder 122 and having a wall thickness 126, a depth 131, and a width 132.

In certain embodiments, the shoulder thickness 125 determines the thickness 124. Generally, the thicker the shoulder thickness 125, the thicker the thickness 124 will be. In some embodiments, the shoulder thickness 125 can be about 0.155 inches. In other embodiments, the shoulder thickness 125 can be in the range of about 0.10-0.30 inches, about 0.15-0.20 inches, or any other thickness that facilitates proper functioning of the system as disclosed herein. In some embodiments, however, the shoulder thickness 125 decreases along one or both of the first shoulder 120 and the second shoulder 122 towards the cam point 110 such that the thickness 124 is smaller than the shoulder thickness 125.

In some embodiments, the depth 131 of the notch 130 can be about 0.7 inches. In other embodiments, the depth 131 can be in the range of about 0.2-1.4 inches, about 0.5-1.0 inches, or any other depth that provides proper acceptance of a second mating element 40 (e.g., a cam point 610 of the second mating element 40) as discussed more fully below. In some embodiments, the width 132 of the notch 130 can be about 0.5 inches. In other embodiments, the width 132 can be in the range of about 0.2-1.0 inches, about 0.5-0.7 inches, or any other width that provides proper acceptance of a second mating element 40 (e.g., a cam point 610 of the second mating element 40), as described more fully below. In some embodiments, the wall thickness 126 of the notch 130 is substantially equal to one or both of the thickness 124 and the shoulder thickness 125. However, in some embodiments, the wall thickness 126 is different than both the thickness 124 and the shoulder thickness 125. In some embodiments, the wall thickness 126 is about 0.14 inches. In other embodiments, the wall thickness 126 can be in the range of about 0.05-0.25 inches, about 0.10-0.20 inches, or any other thickness that facilitates functioning of the system as disclosed herein.

The first cam 22 can have an outer diameter 162 and a length 190. In some embodiments, the outer diameter 162 is about 1.3 inches. In other embodiments, the outer diameter 162 can be in the range of about 0.6-2.1 inches, about 1.0-1.7 inches, or any other diameter that facilitates functioning of the system as disclosed herein. In some embodiments, the length 190 can be about 3.169 inches. In other embodiments, the length 190 can be in the range of about 1.0-5.0 inches, about 2.0-4.0 inches, or any other length that facilitates functioning of the system as disclosed herein. The first cam 22 can be formed by a helical cut having a cam pitch 127 (shown in FIG. 3C) that can dictate a minimum value of the length 190. For example, a first shoulder 120 and a second shoulder 122 having a large cam pitch 127 can form a first cam 22 with a relatively long length 190. By contrast, a first shoulder 120 and a second shoulder 122 having a small cam pitch 127 can form a first cam 22 with a relatively short length 190.

The neck 155 can have an outer diameter 163 and a length 192 (e.g., a distance from where the neck 155 is attached to the body 103 to where the neck 155 is attached to the first cam 22), and can comprise a third shoulder 150 at a proximal end of the neck 155 and having a shoulder angle 151, an example of which is shown in FIG. 3C. The neck 155 can be coupled to the first cam 22 with the third shoulder 150 proximal to the first cam 22. In some embodiments (e.g., as shown in FIG. 3C), the third shoulder 150 can be canted by the shoulder angle 151. In some embodiments, the shoulder angle 151 is about 45 degrees. In other embodiments, the shoulder angle 151 can be in the range of about 20-60 degrees, about 30-50 degrees, or any other angle that permits sufficient seating of a shroud 30, as described more fully below. In yet other embodiments, the shoulder angle 151 can be zero degrees. In some embodiments, the outer diameter 163 can be about 1.44 inches. In other embodiments, the outer diameter 163 can be in the range of about 1.2-1.6 inches, about 1.3-1.5 inches, or any other diameter that allows proper seating and functioning of a shroud 30, as described more fully below. In some embodiments, the length 192 is about 1.3 inches. In other embodiments, the length 192 can be in the range of about 1.0-1.6 inches, about 1.2-1.4 inches, or any other length suitable for connecting the first cam 22 to the body 103.

With reference to FIGS. 2A and 2B, the body 103 can have a body outer diameter 164 and a body length 193 between a proximal end portion 166 coupled to the neck 155 and a distal end portion 170 comprising two or more (e.g., six) faces 180. The faces 180 of the distal end portion 170 can be configured to be engaged by a handheld tool (e.g., wrench) utilized by a technician when assembling or disassembling the body 103 from a first sensor module (e.g., a wireline gyroscope sensor module) to apply a torque to the body 103 or to hold the body 103 secure.

In some embodiments, the proximal end portion 166 terminates in a fourth shoulder 160 proximal to the neck 155. In some embodiments, including the embodiment shown in FIGS. 2A and 2C, the fourth shoulder 160 can be a right angle sharp corner. In other embodiments, not shown, the fourth shoulder 160 can be a canted shoulder comprising an obtuse angle from the surface of the body 103 or a right angle rounded corner. In some embodiments, the fourth shoulder 160 can be about 0.23 inches. In other embodiments the fourth shoulder 160 can be in the range of about 0.1-0.38 inches, about 0.18-0.32 inches, about 0.24-0.26 inches, or any other width that may be conducive to the seating of a shroud 30.

In one embodiment, the body length 193 is about 7.35 inches. In other embodiments, the body length 193 can be in the range of about 3-15 inches, about 6-12 inches, about 8-10 inches, or any other length that facilitates functioning of the systems disclosed herein. It is desirable that the body 103 be sufficiently long that it can accept the entire length of the second mating element 40 (e.g., an elongate member 500, as discussed more fully below).

In one embodiment, the body outer diameter 164 is about 1.75 inches. In other embodiments, the body outer diameter 164 can be in the range of about 1.5-2.0 inches, or any other diameter that allows the socket 140 to accept the second mating element 40 (e.g., elongate member 500, as discussed more fully below). Additionally, the body outer diameter 164 can be selected to not be so large that the sheath 20 will not fit into the wellbore.

In some embodiments, the inner diameter 135 of the socket 140 is about 1.02 inches. In other embodiments, the inner diameter 135 is in the range of about 0.5-1.5 inches, about 0.8-1.2 inches, or any other diameter that facilitates functioning of the system as described herein, particularly an inner diameter 135 that accepts second mating element 40 (e.g., an elongate member 500), as described more fully below.

In some embodiments, the socket 140 can be used to releasably attach the mating element 10 to a sensor module. The sensor module can be, for example, a gyroscope sensor module, an MWD sensor module, or any other drill sensor module, system, or package configured to sense one or more parameters indicative of the position, orientation, or status of a directional drilling system comprising the sensor module. The sensor module may be threadably attached to the socket 140 (which may have internal threads). In some embodiments, a sensor module can be attached to an end of the mating element 10 opposite the first cam 22 through any other means than the socket 140.

FIGS. 4A-4E illustrate various views of one embodiment of a shroud 30 in accordance with certain embodiments described herein. The shroud 30 can comprise a hollow cylinder. The shroud 30 can be configured to be mounted over the first cam 22 and to be part of the first sensor module (e.g., the wireline gyroscope sensor module). When so mounted, the longitudinal axis of the shroud 30 can be coaxial with the axis 24. The shroud 30, when mounted over the first cam 22, can serve as a guide for the second mating element's 40 entry into the mating element 10 prior to full mating of the first cam 22 with the second cam 42.

In at least one embodiment, the shroud 30 can include a first end 310, a second end 320, and a middle portion between the first end 310 and the second end 320. The first end 310 can have a first outer diameter 330 and a first inner diameter 360, the middle portion can have a second outer diameter 331 and a second inner diameter 361, and the second end 320 can have a third outer diameter 332 and a third inner diameter 362. The shroud 30 can have a length 333 from the first end 310 to the second end 320.

The outer profile of the shroud 30 can be defined by the first end 310, the first outer diameter 330, the second outer diameter 331, the third outer diameter 332, the second end 320, and the length 333. In some embodiments, the first inner diameter 360 can transition to the second inner diameter 361 at a first shoulder 381, which can have a first angle 372, and the second inner diameter 361 can transition to the third inner diameter 362 at a second shoulder 353.

In some embodiments, the first outer diameter 330 at the first end 310, the second outer diameter 331, and the third outer diameter 332 at the second end 320 are all substantially equal to one another. In one embodiment, the first outer diameter 330, second outer diameter 331, and third outer diameter 332 are each and all about 2.125 inches. In embodiments in which the first outer diameter 330, second outer diameter 331, and third outer diameter 332 are substantially equal, the first outer diameter 330, second outer diameter 331, and third outer diameter 332 can be in the range of about 1.5-2.5 inches, about 1.7-2.3 inches, about 1.9-2.1 inches or any other diameter that facilitates functioning of the systems disclosed herein.

In some embodiments, the first outer diameter 330, the second outer diameter 331, and the third outer diameter 332 are not all equal. In such embodiments, the first outer diameter 330 can be larger than the second outer diameter 331 which can be larger than the third outer diameter 332, thereby creating a conical shroud 30 with a larger diameter at the first end 310 than at the second end 320. Alternatively, in other embodiments, the third outer diameter 332 can be larger than the second outer diameter 331 which can be larger than the first outer diameter 330, thereby creating a conical shroud 30 with a larger diameter at the second end 320 than at the first end 310. In such embodiments, all of the first outer diameter 330, second outer diameter 331, and third outer diameter 332 can be in the range of about 1.5-2.5 inches, about 1.7-2.3 inches, about 1.9-2.1 inches or any other diameter that facilitates functioning of the systems disclosed herein.

In some embodiments, the first end 310 can terminate in a ring 340. In some embodiments, the ring 340 can be a rounded edge (as shown in FIG. 4E). The ring 340 having a rounded edge can advantageously improve guidance of the elongate member 500 of the second mating element 40 into the first cam 22 and the mating element 10. The rounded edge may advantageously prevent binding of the second mating element 40 against the shroud 30. In some embodiments, the ring 340 can have a flat surface. In some embodiments, the ring 340 is polished. In some embodiments, the ring 340 is substantially parallel to a longitudinal axis of the shroud 30. In other embodiments, the ring may be oriented at an angle to the longitudinal axis of the shroud 30.

Figure 4A:
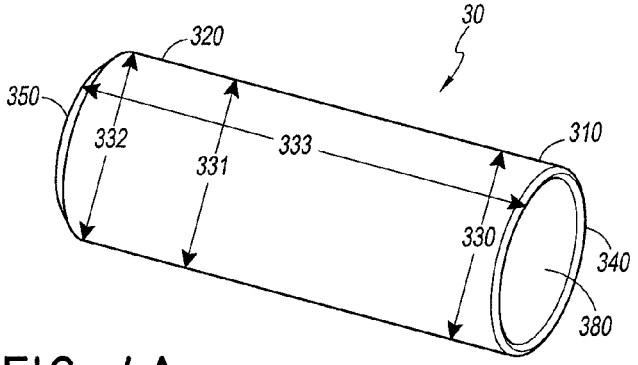
FIGS. 4A-4B are front-biased, side views of an example shroud in accordance with certain embodiments described herein.
Figure 4B:
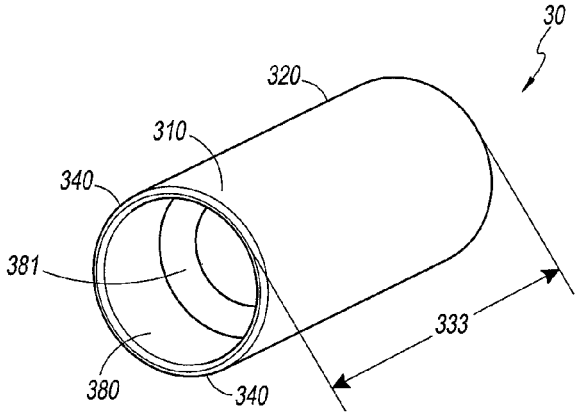
Figure 4C:
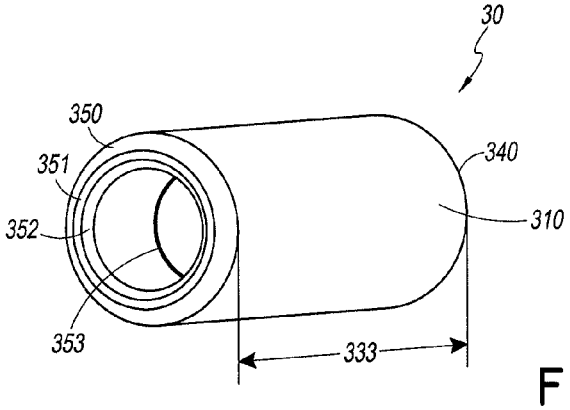
FIG. 4C is a rear-biased, side view of the example shroud of FIG. 4A.
Figure 4D:
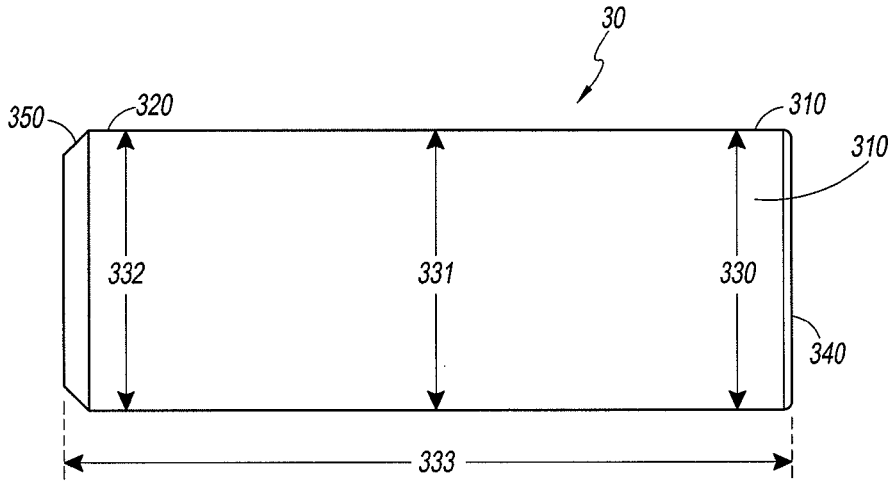
FIG. 4D is a side view of the example shroud of FIG. 4A.
Figure 4E:
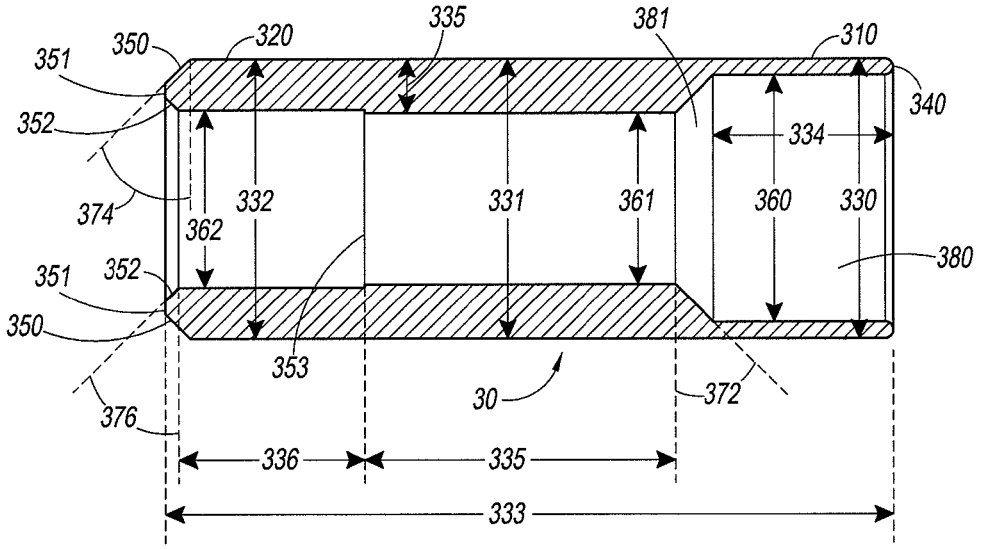
FIG. 4E is a cut-away side view of the example shroud of FIG. 4A.

FIGS. 4C and 4E, illustrate the second end 320 of the shroud 30. In some embodiments, the second end 320 terminates in an outer shoulder 350, a flat surface 351, and an inner shoulder 352. In certain embodiments, the outer shoulder 350 can have a second angle 374. In certain embodiments, the inner shoulder 352 can have a third angle 376.

In some embodiments, the second angle 374 of the outer shoulder 350 can be about 40 degrees. In other embodiments, the second angle 374 is in the range of about 20-60 degrees, about 26-54 degrees, about 32-48 degrees, about 38-42 degrees, or any other angle that facilitates proper functioning of the systems disclosed herein. In some embodiments, the third angle 376 of the inner shoulder 352 can be about 40 degrees. In other embodiments, the third angle 376 is in the range of about 20-60 degrees, about 26-54 degrees, about 32-48 degrees, about 38-42 degrees, or any other angle that facilitates proper functioning of the systems disclosed herein.

In some embodiments, the flat surface 351 can be substantially flat and/or substantially perpendicular to the longitudinal axis of the shroud 30. In some embodiments, the second end 320 terminates only in a flat surface 351. That is to say, there is no second angle 374 and no third angle 376 and therefore no outer shoulder 350 or inner shoulder 352. In such embodiments, the second end 320 is a right angled flat surface substantially perpendicular to the longitudinal axis of the shroud 30.

With continued reference to FIGS. 4A-4E, the shroud 30 can have a length 333. In some embodiments, the length 333 can be about 5.5 inches. In other embodiments, the length 333 can be in the range of about 1.0-10.0 inches, about 3.0-8.0 inches, about 5.0-6.0 inches, or any other length 333 that facilitates functioning of the systems disclosed herein.

FIG. 4E illustrates a cut-away of a shroud 30 in accordance with certain embodiments described herein. The shroud 30 can have a shroud socket 380 configured to receive a portion of the second mating element 40. The shroud socket 380 can be defined generally by the first inner diameter 360, the first shoulder 381, the second inner diameter 361, the second shoulder 353, and the third inner diameter 362.

In some embodiments, a portion of the shroud 30 having the first inner diameter 360 extends from the first end 310 along the longitudinal axis of the shroud 30 to the first shoulder 381 by a first depth 334, forming the proximal opening to the shroud socket 380. In some embodiments, the first shoulder 381 can provide a transition from the first inner diameter 360 to the second inner diameter 361. In some embodiments, the first inner diameter 360 is larger than the second inner diameter 361. In other embodiments, the first inner diameter 360 is smaller than second inner diameter 361. In some embodiments, the second shoulder 353 can provide a transition from the third inner diameter 362 to the second inner diameter 361. In some embodiments, the third inner diameter 362 is larger than the second inner diameter 361. In other embodiments, the third inner diameter 362 is smaller than the second inner diameter 361. In still other embodiments, there is no change from the third inner diameter 362 to the second inner diameter 361. A portion of the shroud 30 having the second inner diameter 361 can extend from the first shoulder 381 along the longitudinal axis of the shroud 30 to the second shoulder 353 by a second depth 335. A portion of the shroud 30 having the third inner diameter 362 can extend from the second shoulder 353 along the longitudinal axis of the shroud 30 to the second end 320 by a third depth 336.

In some embodiments, the first inner diameter 360 is about 1.875 inches. In other embodiments, the first inner diameter 360 can be in the range of about 1.55-2.45 inches, about 1.70-2.3 inches, about 1.85-2.15 inches, about 1.95-2.05 inches, or any other diameter that facilitates functioning of the systems disclosed herein. In some embodiments, the first depth 334 can be about 1.3 inches. In other embodiments, the first depth 334 can be in the range of about 0.5-2.1 inches, about 0.9-1.7 inches, about 1.2-1.4 inches, or any other depth that facilitates functioning of the systems disclosed herein.

In some embodiments, the first shoulder 381 can have a first angle 372 of about 45 degrees. In other embodiments, the first angle 372 can be in the range of about 20-60 degrees, about 30-50 degrees, about 35-45 degrees, or any other angle that facilitates functioning of the systems disclosed herein. In some embodiments, the first angle 372 can be 0 degrees. In such embodiments, the shroud socket 380 changes diameter at the first shoulder 381 at a right angle step.

In some embodiments, the second inner diameter 361 can be about 1.3 inches. In other embodiments, the second inner diameter 361 can be in the range of about 0.6-2.1 inches, about 0.9-1.8 inches, about 1.3-1.4 inches, or any other diameter that facilitates functioning of the systems disclosed herein. In some embodiments, the second depth 335 is about 2.35 inches. In other embodiments, the second depth 335 can be in the range of about 1.5-3.1 inches, about 1.8-2.8 inches, about 2.1-2.5 inches, about 2.2-2.4 inches, or any other depth that facilitates functioning of the systems described herein.

In some embodiments, the third inner diameter 362 can be about 1.44 inches. In other embodiments, the third inner diameter 362 can be in the range of about 1.2-1.6 inches, about 1.26-1.54 inches, about 1.32-1.48 inches, about 1.38-1.42 inches, or any other diameter that allows proper seating of the shroud 30 over the first cam 22 and the neck 155 (to be discussed more fully below). In some embodiments, the third depth 336 can be about 1.3 inches. In other embodiments, the third depth 336 can be in the range of about 0.8-1.8 inches, about 1.0-1.6 inches, about 1.2-1.4 inches, or any other depth substantially equal to or capable of substantially covering the neck 155.

In some embodiments, the second shoulder 353 forms a right corner step. In still other embodiments, the third inner diameter 362 is equal or substantially equal to the second inner diameter 361 (in such embodiments, a second shoulder 353 is not present).

FIGS. 5A-5E illustrate various views of an example mating element 10 in accordance with certain embodiments described herein. In at least one embodiment, the mating element 10 can include a sheath 20 and a shroud 30.

In some embodiments, the shroud 30 can be disposed around the neck 155 and the first cam 22. With additional reference to FIGS. 3C and 4D-4E, the shroud 30 may be disposed around the neck 155 and the first cam 22 such that the flat surface 351 seats against the fourth shoulder 160 of the proximal end portion 166. In some embodiments, as clearly illustrated in FIG. 5C, when the shroud 30 is fully seated on the sheath 20, the flat surface 351 of the shroud 30 abuts the fourth shoulder 160 of the proximal end portion 166, and the second shoulder 353 of the shroud 30 abuts the third shoulder 150 of the neck 155.

Figure 5A:
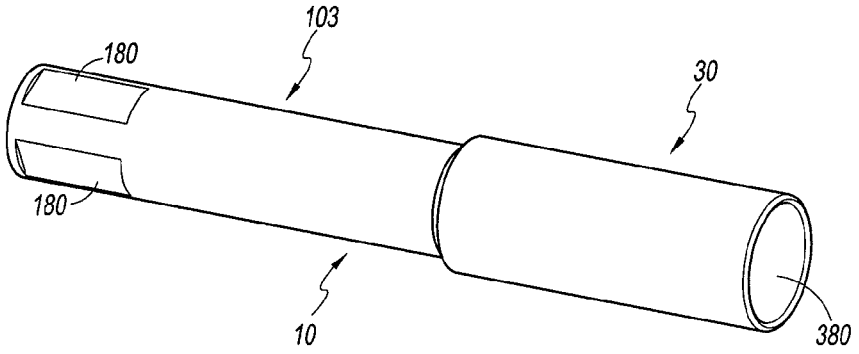
FIG. 5A is a front-biased, side view of an example mating element in accordance with certain embodiments described herein.
Figure 5B:
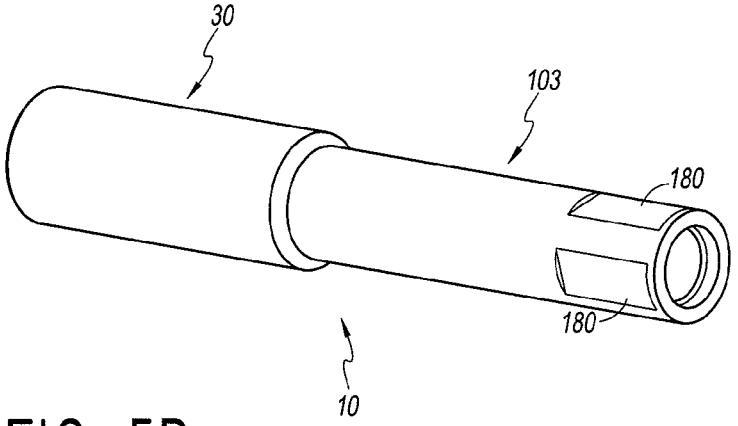
FIG. 5B is a rear-biased, side view of the example mating element of FIG. 5A.
Figure 5C:
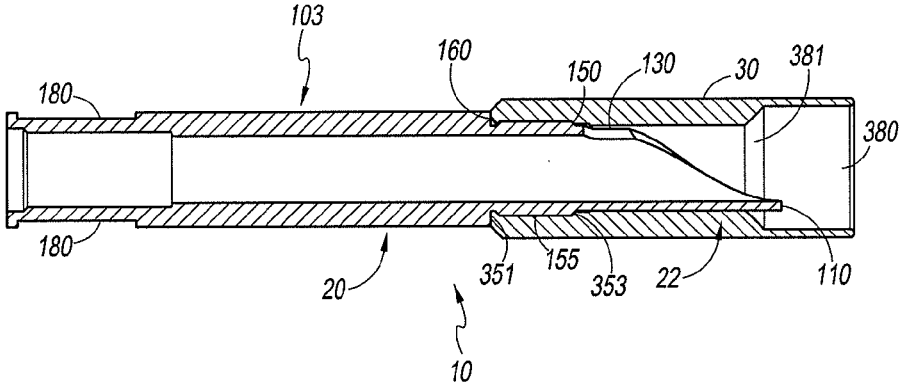
FIG. 5C is a cut-away, side view of the example mating element of FIG. 5A.

As discussed above, the third inner diameter 362 and the second inner diameter 361 of the shroud 30 can have certain dimensions and the outer diameter 163 and the outer diameter 162 of the of the neck 155 and the first cam 22, respectively, can have certain dimensions. In some embodiments, the third inner diameter 362 of the shroud 30 is substantially equal to the outer diameter 163 of the neck 155. In some embodiments, the third inner diameter 362 of the shroud 30 is only slightly larger than the outer diameter 163 of the neck 155. In some embodiments, the second inner diameter 361 of the shroud 30 is substantially equal to the outer diameter 162 of the first cam 22. In some embodiments, the second inner diameter 361 of the shroud 30 is only slightly larger than the outer diameter 162 of the first cam 22. Therefore, as shown in FIG. 5C, when disposed around the neck 155 and the first cam 22, the shroud 30 can create a cavity around the proximal end of the first cam 22.

In some embodiments, the shroud 30 can be reversibly or removably fixed to the sheath 20. In some embodiments, the sheath 20 and the shroud 30 can have mating threads such that the shroud 30 can be threadably attached to the sheath 20. In such embodiments, the threads of the sheath 20 can be disposed on the surface of the neck 155 and the threads of the shroud 30 can be disposed near the second end 320 of the shroud 30. In other embodiments, the shroud 30 can be fixed to the sheath 20 using external bushings, nuts, or other coupling or tightening systems.

In some embodiments, the shroud 30 is permanently fixed to the sheath 20. In some embodiments, the shroud 30 is friction welded to the sheath 20. In embodiments in which friction welding is used, the inner surface of the distal portion of the shroud 30 and the exterior surface of the neck 155 can be given a smooth surface finish and the third inner diameter 362 can be substantially equal to the outer diameter 163. Therefore, the shroud 30 can be forced onto the sheath 20 and the metals can be cold welded to form a permanent bond between the shroud 30 and the sheath 20. In other embodiments, the shroud 30 can be hot welded to the sheath 20. In still other embodiments, the shroud 30 can be integrally formed with the sheath 20, such as by casting or by machining. In yet other embodiments, the shroud 30 can be permanently fixed to the sheath 20 using one or more of glues, epoxies, or cements.

Figure 5D:
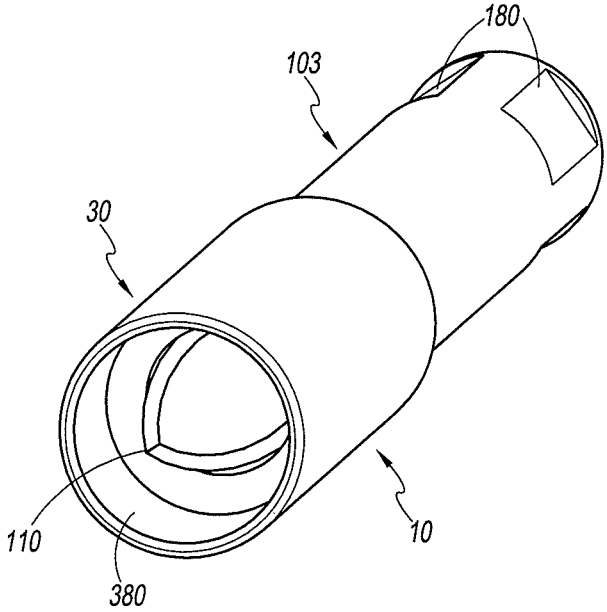
FIGS. 5D-5E are front-biased three-quarter views of the example mating element of FIG. 5A.
Figure 5E:
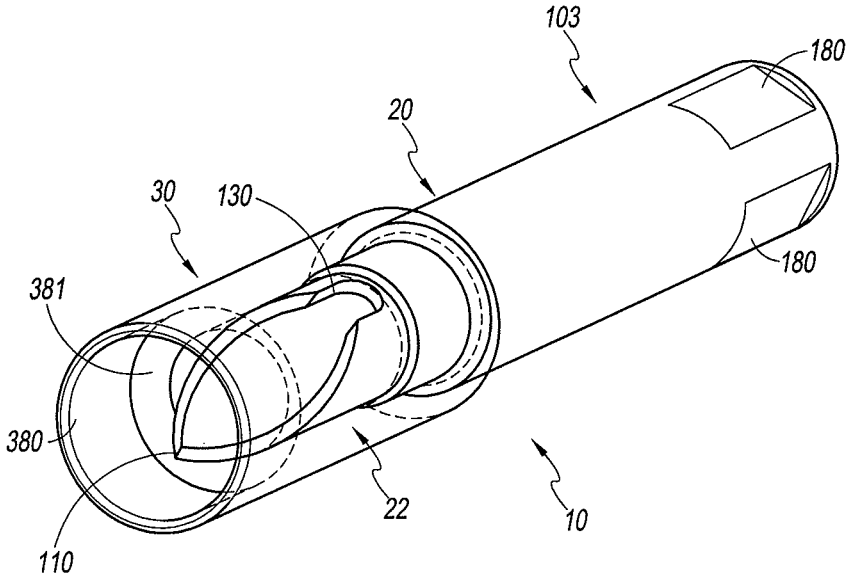

FIGS. 5D and 5E illustrate an example shroud 30 in place over a first cam 22 and a neck 155 on a sheath 20 in accordance with certain embodiments described herein. FIG. 5E illustrates a transparency view of the shroud 30 in place over the first cam 22 and neck 155 on the sheath 20. In certain embodiments, the shroud 30 can create a shroud socket 380 surrounding the first cam 22.

In some embodiments, the shroud 30 extends past the cam point 110. In some embodiments, the shroud 30 extends past the cam point 110 for a distance of about 1.1 inches. In other embodiments, the shroud 30 can extend past the cam point 110 in the range of about 0.1-2.1 inches, about 0.4-1.8 inches, about 0.7-1.5 inches, about 1.0-1.3 inches, or any other distance that facilitates functioning of the systems disclosed herein. In other embodiments, the cam point 110 of the first cam 22 can extend past the first end 310 of the shroud 30. In some embodiments, the cam point 110 can extend past the end of the shroud 30 in the range of about 0.1-2.1 inches, about 0.4-1.8 inches, about 0.7-1.5 inches, about 1.0-1.3 inches, or any other distance that facilitates functioning of the systems disclosed herein.

Figure 8A:
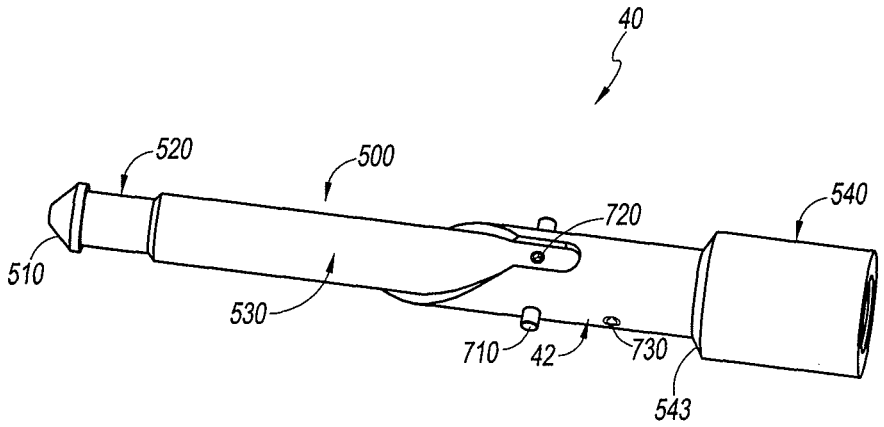
FIG. 8A is a view of an example second mating element in accordance with certain embodiments described herein.
Figure 8B:
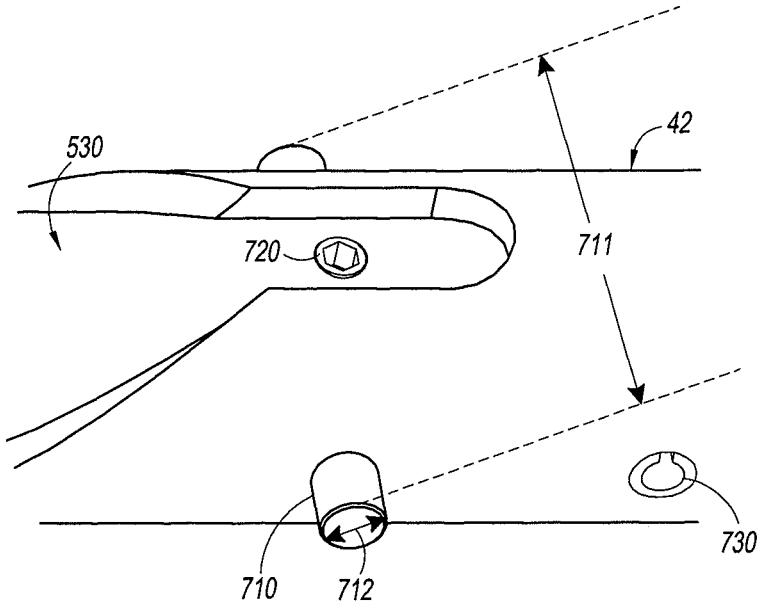
FIG. 8B is an enlarged view of the example second mating element of FIG. 8A.

FIGS. 8A-8B illustrate various views of an example second mating element 40 in accordance with certain embodiments described herein. The second mating element 40 can be configured to be mounted to a second sensor module (e.g., a down-hole portion of a drilling sensor module such as an MWD sensor module) and can serve as an alignment tool to couple the second sensor module with the first sensor module (e.g., a wireline gyroscope sensor module within the wellbore) and to orient the second sensor module to the first sensor module with a predetermined orientation.

Figure 6A:
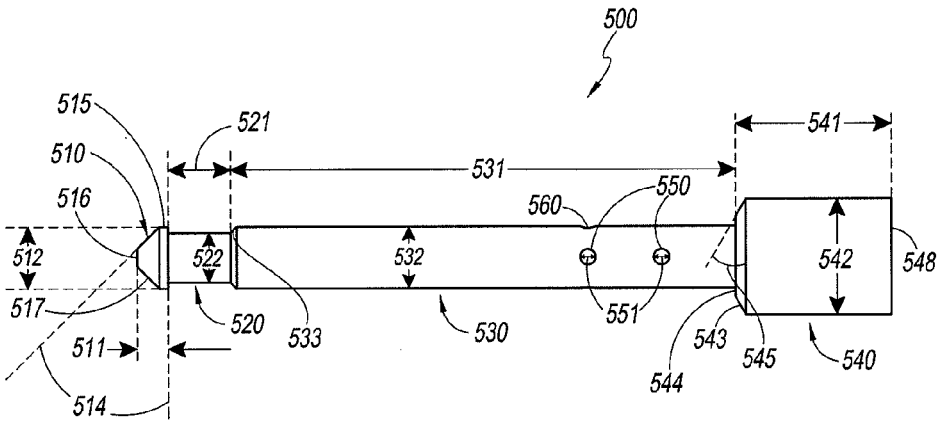
FIG. 6A is a side view of an example elongate portion of a second mating element in accordance with certain embodiments described herein.
Figure 6B:
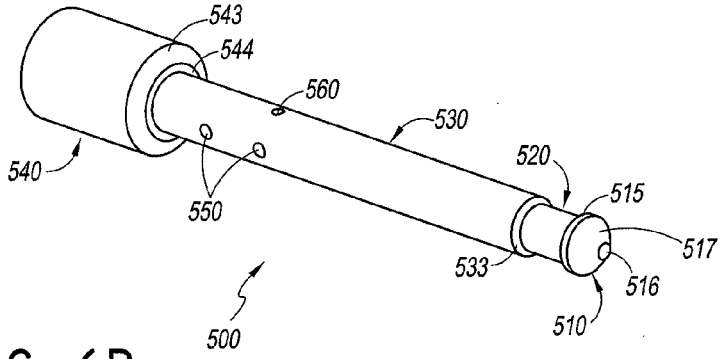
FIG. 6B is a top-biased, front three-quarters view of the example elongate portion of FIG. 6A.
Figure 6C:
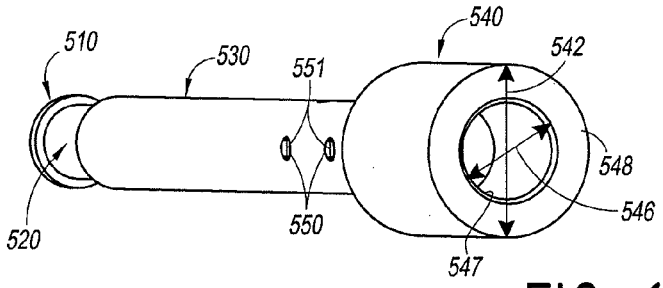
FIG. 6C is a rear-biased, side view of the example elongate portion of FIG. 6A.

FIGS. 6A-6C illustrate an example elongate member 500 in accordance with certain embodiments described herein. The second mating element 40 comprises an elongate member 500 and a second cam 42 complementary to the first cam 22. The elongate member 500 can further comprise a head 510, a neck 520, a body 530, and a base 540. As shown in FIG. 6A, the head 510 is attached to the neck 520 which is attached to the body 530 which is further attached to the base 540 to form the elongate member 500.

With reference to FIG. 6A, the head 510 comprises a generally conical shape with a flattened tip 516 and a ring 515. The head 510 has a first length 511 and a first diameter 512. In some embodiments, the first length 511 is about 0.5 inches. In other embodiments, the first length 511 can be in the range of about 0.22-0.78 inches, about 0.34-0.66 inches, about 0.48-0.52 inches, or any other length that facilitates functioning of the systems disclosed herein. In some embodiments, the first diameter 512 is about 1.0 inches. In other embodiments, the first diameter 512 can be in the range of about 0.5-1.5 inches, about 0.7-1.3 inches, about 0.9-1.1 inches, or any other diameter that facilitates functioning of the systems described herein, particularly fitting axially in a socket 140 of a mating element 10 having an inner diameter 135.

The conical shape of the head 510 can be defined by a first shoulder 518, which, in turn, can be defined by a first angle 514. The first angle 514 can be in the range of about 20-50 degrees, about 28-42 degrees, about 34-36 degrees, or any other angle that facilitates functioning of the systems described herein. In some embodiments, the first shoulder 517 can terminate in a round, flattened tip 516 (shown in FIG. 6B). In some embodiments, the tip 516 has a diameter of about 0.28 inches. In other embodiments, the tip 516 can have a diameter in the range of about 0.1-0.46 inches, about 0.18-0.38 inches, about 0.26-0.30 inches, or any other diameter that facilitates functioning of the systems described herein.

With continued reference to FIG. 6A, in certain embodiments, the head 510 can be connected to the neck 520. The neck 520 can be attached to the head 510 on one end of the neck 520 and attached to the body 530 on another end of the neck 520. The neck 520 has a second length 521 and a second diameter 522. In some embodiments, the second length 521 is about 1.0 inches. In other embodiments, the second length 521 can be in the range of about 0.20-1.80 inches, about 0.50-1.50 inches, about 0.70-1.30 inches, about 0.95-1.05 inches, or any other length that facilitates functioning of the systems described herein. In some embodiments, the second diameter 522 is about 0.8 inches. In other embodiments, the second diameter 522 can be in the range of about 0.3-1.3 inches, about 0.5-1.1 inches, about 0.7-0.9 inches, or any other diameter that facilitates functioning of the systems disclosed herein.

In certain embodiments, the neck 520 can be connected to the body 530. The body 530 can be attached to the neck 520 on one end of the body 530 and attached to the base 540 on another end of the body 530. The body 530 has a third length 531 and a third diameter 532. In some embodiments, the third length 531 can be about 8.13 inches. In other embodiments, the third length 531 can be in the range of about 2.00-14.00 inches, about 4.0-12.0 inches, about 6.0-10.0 inches, about 7.5-8.5 inches, or any other length that facilitates functioning of the systems disclosed herein. In some embodiments, the third diameter 532 can be about 1.0 inches. In other embodiments, the third diameter 532 can be in the range of about 0.5-1.5 inches, about 0.7-1.3 inches, about 0.9-1.1 inches, or any other diameter that facilitates functioning of the systems described herein, particularly a diameter that will fit axially in a socket 140 of a mating element 10 having an inner diameter 135.

In some embodiments, the body 530 comprises a second shoulder 533. In some embodiments, the second shoulder 533 has an angle of about 45 degrees. In other embodiments, the second shoulder 533 can have an angle in the range of about 20-60 degrees, about 30-50 degrees, about 35-45 degrees, or any other angle that facilitates functioning of the systems described herein. In yet other embodiments, the angle of the second shoulder 533 can be zero degrees, or a right angle.

In some embodiments, the body 530 comprises at least one first hole 550 configured to receive at least one pin 710, as described more fully below. The first hole 550 can be a hole having a diameter 551 disposed through the body 530. The first hole 550 can be substantially perpendicular to the longitudinal axis of the body 530. In some embodiments, the diameter 551 can be in the range of about 0.1-0.4 inches, about 0.2-0.3 inches, or any other diameter that facilitates functioning of the systems disclosed herein. In some embodiments, the body 530 comprises more than one first hole 550, including two, three, four, five or even six first holes 550. In another embodiment, no first holes 550 are used.

In some embodiments, the body 530 can comprise at least one second hole 560. As will be discussed more fully below, the second hole 560 can be threaded and substantially perpendicular to and generally intersecting one or more first holes 550. A threaded screw can be screwed into the second hole 560 until it hits a pin 710 disposed through the first hole 550, thereby reversibly fixing the pin 710 in place.

With continued reference to FIG. 6A, in certain embodiments, the base 540 comprises a generally cylindrical shape with a third shoulder 543 and a socket 547. The base 540 forms one end of the elongate member 500 and has a fourth length 541 and a fourth diameter 542. In some embodiments, the fourth length 541 is about 2.334 inches. In other embodiments, the fourth length 541 can be in the range of about 1.0-3.0 inches, about 1.6-3.4 inches, about 2.4-2.6 inches, or any other length that facilitates functioning of the systems described herein. In some embodiments, the fourth diameter 542 is about 1.875 inches. In other embodiments, the fourth diameter 542 can be in the range of about 1.0-2.6 inches, about 1.6-2.0 inches, or any other diameter that facilitates functioning of the systems described herein.

In some embodiments, the base 540 can be a right cylinder. With reference to FIGS. 6A and 6B, the base 540 can comprise a third shoulder 543 and a seat 544. The third shoulder 543 can be defined by a second angle 545. In some embodiments, the second angle 545 is about 45 degrees. In other embodiments, the second angle 545 can be in the range of about 20-60 degrees, about 35-45 degrees, or any other angle that facilitates functioning of the systems described herein. As mentioned above, the second angle 545 can also be zero degrees, rendering the third shoulder 543 coplanar with the seat 544 (effectively making the base 540 a right cylinder). The seat 544 can be a flat ring, substantially perpendicular to the longitudinal axis of the elongate member 500, at the junction of the base 540 and the body 530. In some embodiments, the seat 544 is about 0.15 inches wide. In other embodiments, the width of the seat 544 can be in the range of about 0.05-0.25 inches, about 0.10-0.20 inches, about 0.14-0.16 inches, or any other width that permits the seating of the second cam 42 as will be discussed more fully below.

With reference to FIG. 6C, the base 540 can further comprise an end 548. In some embodiments, the end 548 is a right angle flat surface, substantially perpendicular to the longitudinal axis of the elongate member 500. In some embodiments, the end 548 can include a socket 547 with a fifth inner diameter 546. In some embodiments, the socket 547 can be used to releasably attach the elongate member 500 and/or the second mating element 40 to a sensor module. The sensor module can be, for example, a gyroscope sensor module, an MWD sensor module, or any other drill sensor module, system, or package configured to sense one or more parameters indicative of the position, orientation, or status of a directional drilling system comprising the sensor module. For example, the sensor module may be threadably attached to the socket 547 (which may have internal threads). In some embodiments, a sensor module can be attached to an end of the second mating element 40 opposite the head 510 through some other means than the socket 547.

Figure 7A:
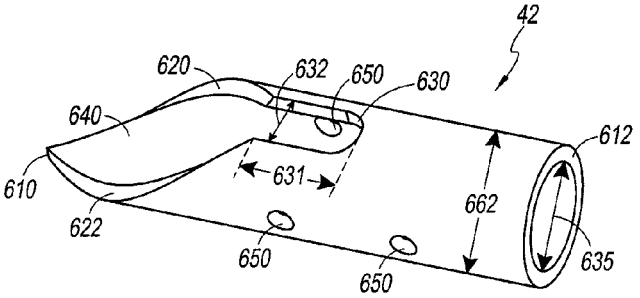
FIGS. 7A-7D are varying views of an example second cam in accordance with certain embodiments described herein.
Figure 7B:
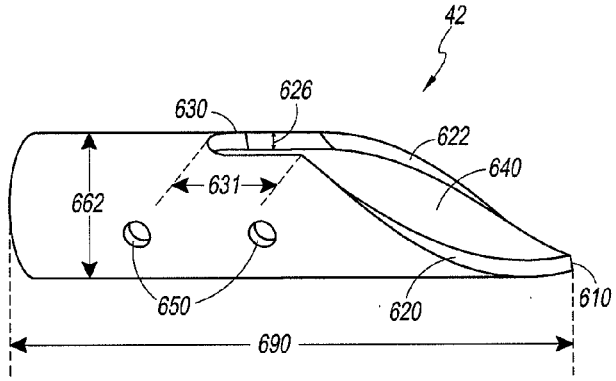
Figure 7C:
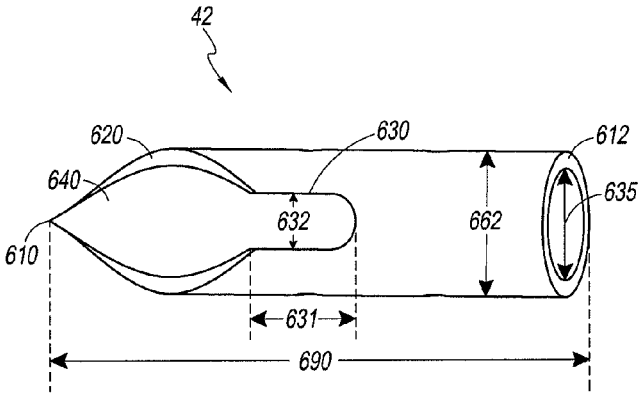
Figure 7D:
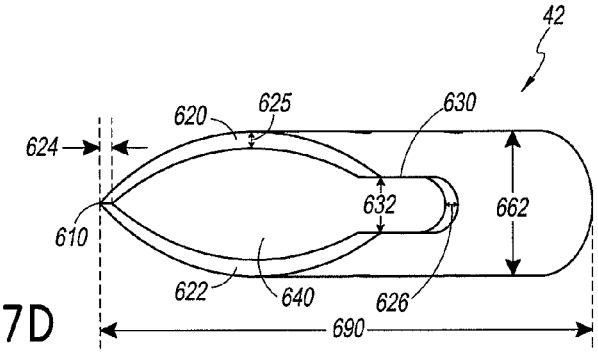
Figure 7E:
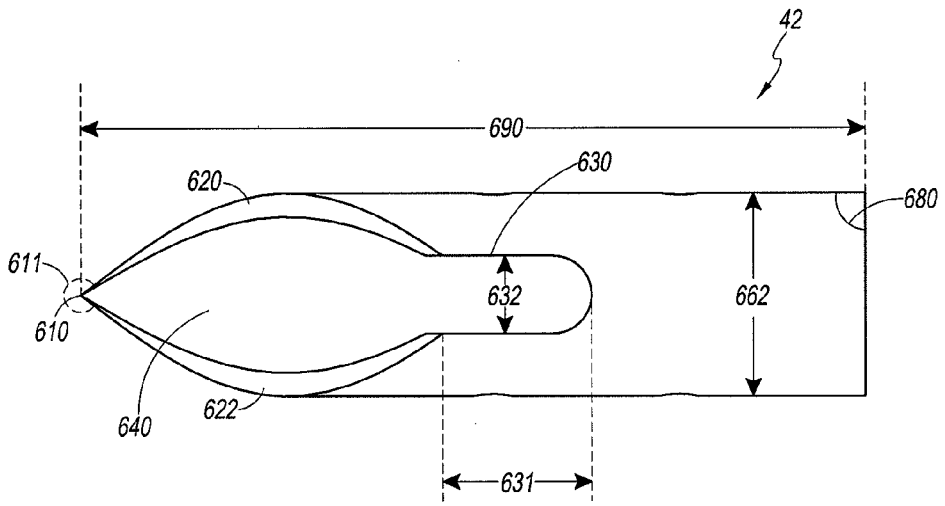
FIG. 7E is a top view of the example second cam of FIG. 7A.
Figure 7F:
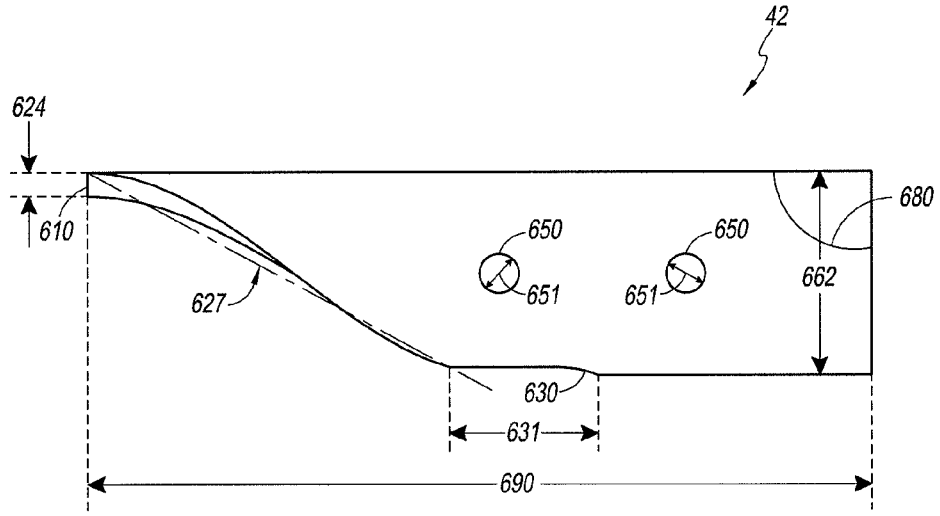
FIG. 7F is a right, side view of the example second cam of FIG. 7A.

FIGS. 7A-7F illustrate an example second cam 42 in accordance with certain embodiments described herein. As illustrated in FIGS. 7B and 7F, the second cam 42 can have a shape that roughly resembles an obliquely cut pipe. However, the second cam 42 can include a precisely formed shape.

As can be seen in FIG. 7D, the second cam 42 extends from the cam point 610 into a first shoulder 620 and a second shoulder 622, each having a thickness 625. In some embodiments, the first shoulder 620 and the second shoulder 622 are bilaterally symmetrical with one another. As shown in FIGS. 7C-7E, the first shoulder 620 and the second shoulder 622 can each have a surface (e.g., face) configured to mate with corresponding surfaces (e.g., faces) of the shoulders of the first cam. The surfaces can be substantially flat across the shoulder thickness 625. FIGS. 7C-7E show close up views of an example first shoulder 620 and second shoulder 622 having flat faces for which there is substantially no radial curvature across the thicknesses of the first shoulder 620 and the second shoulder 622. For example, each surface can comprise a flat face for which all points to the left and right of a given center point of the shoulder lie on a single geometric line perpendicular to the longitudinal axis of the shoulder. In other embodiments, the first shoulder 620 and the second shoulder 622 have rounded faces. In some embodiments, the first shoulder 620 and the second shoulder 622 meet in a pointed fashion, such that the bases of the first shoulder 620 and the second shoulder 622 form a "negative" of the cam point 610. In other embodiments, as shown in FIGS. 7C-7E, the second cam 42 further comprises a notch 630 between the first shoulder 620 and the second shoulder 622 and having a wall thickness 626, a depth 631, and a width 632.

In certain embodiments, the shoulder thickness 625 determines the thickness 624. Generally, the thicker the shoulder thickness 625, the thicker the thickness 624 will be. In some embodiments, the shoulder thickness 625 can be about 0.155 inches. In other embodiments, the shoulder thickness 625 can be in the range of about 0.10-0.30 inches, about 0.15-0.20 inches, or any other thickness that facilitates proper functioning of the system as disclosed herein. In some embodiments, however, the shoulder thickness 625 decreases along one or both of the first shoulder 620 and second shoulder 622 towards the cam point 610 such that the thickness 624 is smaller than the shoulder thickness 625. In some embodiments, the thickness 624 can be about 0.14 inches. In other embodiments, the thickness 624 can be in the range of about 0.05-0.25 inches, about 0.10-0.20 inches, or any other thickness that facilitates functioning of the system as disclosed herein.

In some embodiments, the depth 631 of the notch 630 can be about 0.7 inches. In other embodiments, the depth 631 can be in the range of about 0.2-1.4 inches, about 0.5-1.0 inches, or any other depth that provides proper acceptance of a mating element 10 (e.g., a first cam point 110 of the mating element 10) as will be discussed more fully below. In some embodiments, the width 632 of the notch 630 can be about 0.5 inches. In other embodiments, the width 632 can be in the range of about 0.2-1.0 inches, about 0.5-0.7 inches, or any other width that provides proper acceptance of a mating element 10 (e.g., a first cam point 110 of the mating element 10) as will be discussed more fully below. In some embodiments, the wall thickness 626 of the notch 630 is substantially equal to one or both of the thickness 624 and the shoulder thickness 625. However, in some embodiments, the wall thickness 626 is different than the thickness 624 or the shoulder thickness 625. In some embodiments, the wall thickness 626 is about 0.14 inches. In other embodiments, the wall thickness 626 can be in the range of about 0.05-0.25 inches, about 0.10-0.20 inches, or any other thickness that facilitates functioning of the systems disclosed herein.

The second cam 42 can have an outer diameter 662 and a length 690. In some embodiments, the outer diameter 662 is about 1.3 inches. In other embodiments, the outer diameter 662 can be in the range of about 0.6-2.1 inches, about 1.0-1.7 inches, or any other diameter that facilitates functioning of the system as disclosed herein. In some embodiments, the length 690 can be about 3.169 inches. In other embodiments, the length 690 can be in the range of about 1.0-5.0 inches, about 2.0-4.0 inches, or any other length that facilitates functioning of the system as disclosed herein. The second cam 42 can be formed by a helical cut having a cam pitch 627 (shown in FIG. 7F) that can dictate a minimum value of the length 690. For example, a first shoulder 620 and a second shoulder 622 having a large cam pitch 627 can form a second cam 42 with a relatively long length 690. By contrast, a first shoulder 620 and a second shoulder 622 having a small cam pitch 627 can form a second cam 42 with a relatively short length 690.

In some embodiments, the second cam 42 comprises a bottom surface 612 at the opposite end of the second cam 42 from the cam point 610. The bottom surface can be at an angle 680 to the longitudinal axis of the second cam 42. In some embodiments, the angle 680 is about 90 degrees, or a right angle.

In some embodiments, the second cam 42 comprises a socket 640. The socket 640 is a cavity extending the entire length of the second cam 42. The socket 640 comprises an inner diameter 635 (as shown in FIGS. 7A and 7C). In some embodiments, the inner diameter 635 of the socket 640 is about 1.02 inches. In other embodiments, the inner diameter 635 is in the range of about 0.5-1.5 inches, about 0.8-1.2 inches, or any other diameter that facilitates functioning of the system as described herein, particularly an inner diameter 635 that accepts and fits around the body 530 of an elongate member 500 as described more fully below.

In some embodiments, the second cam 42 can have at least one first cam hole 650 configured to receive the at least one pin 710. The at least one first cam hole 650 and the at least one pin 710 can advantageously stabilize (e.g., hold) the second cam 42 in place on the elongate member 500, as described more fully below. In some embodiments, the second cam 42 can have two, three, four, five or even six first cam holes 650. In embodiments in which the second cam 42 has one or more first cam holes 650, the first cam hole 650 can be disposed through the second cam 42 substantially perpendicular to the longitudinal axis of the second cam 42. The first cam hole 650 can have a diameter 651. In some embodiments, the diameter 651 of the first cam hole 650 can be in the range of about 0.1-0.4 inches, about 0.15-0.35 inches, about 0.2-0.3 inches, or any other diameter that facilitates functioning of the systems disclosed herein, particularly the acceptance of the pin 710 through the first cam hole 650 as described more fully below.

As discussed above, the second mating element 40 can comprise at least an elongate member 500, a second cam 42 (complementary to the first cam 22), a pin 710, a first fixing element 720, and a second fixing element 730. With reference to FIGS. 8A-8B, in some embodiments, the second cam 42 can be disposed around the body 530 of the elongate member 500. In some embodiments, the inner diameter 635 of the second cam 42 is substantially equal to, or only just slightly larger than the third diameter 532 of the body 530. Therefore, the second cam 42 can slip over the head 510, the neck 520, and the body 530 and down over the body 530 until it butts up against the seat 544 (as shown in FIG. 6A, 6B).

The first hole 550 of the body 530 and the first cam hole 650 of the second cam 42 can be aligned so that a hole extends through both the body 530 and the second cam 42. Such holes can be used to reversibly or permanently fix the second cam 42 to the elongate member 500. In some embodiments, a pin 710 is placed through both the aligned first hole 550 and first cam hole 650 to hold the second cam 42 in place. In certain embodiments, the second cam 42 can be held in place on the elongate member 500 by the second fixing element 730 and the pin 710, which itself can be held in place by the first fixing element 720, as described more fully below.

In some embodiments, the pin 710 has a diameter 751 and a length 711. In some embodiments, the length 711 is about 1.875 inches. In other embodiments, the length 711 can be in the range of about 1.55-2.45 inches, about 1.75-2.25 inches, about 1.95-2.05 inches, or any other length that facilitates functioning of the systems disclosed herein (namely any length that fits inside a first inner diameter 360 of a shroud 30). In some embodiments, the diameter 751 can be in the range of about 0.1-0.4 inches, about 0.2-0.3 inches, or any other diameter that facilitate functioning of the systems disclosed herein (namely, any other diameter that will fit through a first hole 550 with diameter 551 and a first cam hole 650 with a diameter 651). In some embodiments, the diameter 751 is close enough to diameter 551 and diameter 651 that the second cam 42 can be reversibly fixed in place by the driving pin 710 through the first cam hole 650 and the first hole 550. In such embodiments, the pin 710 can be held in place by friction.

In some embodiments, only a single pin 710 is used. In other embodiments, 2 pins 710 can be used. In still other embodiments, 3, 4, 5, or even 6 pins 710 can be used. In some embodiments, no pin 710 is used.

In some embodiments, a first fixing element 720 can be used. In some embodiments, such as that shown in FIG. 8B, a threaded second hole 560 extends through the body 530 perpendicular to a first hole 550. A first fixing element 720, e.g., a threaded screw, can be inserted into a threaded second hole 560 and tightened down on the pin 710, until it is firmly held it in place.

In some embodiments, at least one second fixing element 730 can be used. The second fixing element 730 can be passed through a first cam hole 650 and a first hole 550 to further fix the second cam 42 to the body 530. In some embodiments, the second fixing element 730 can be a c-member (as shown in FIG. 8B) having a diameter slightly larger than either the diameter 651 of the first cam hole 650 or the diameter 551 of the first hole 550. In operation, the c-member can be compressed to fit within the first hole 550 and the first cam hole 650 and inserted through the aligned holes. Once in place, the outward force created by the second fixing element 730 c-member attempting to expand can tend to hold the second cam 42 in place on the body 530.

In some embodiments, only a single second fixing element 730 is used. In other embodiments, 2 second fixing elements 730 can be used. In still other embodiments, 3, 4, 5, or even 6 second fixing elements 730 can be used. In some embodiments, no second fixing element 730 are used.

As described herein, the second cam 42 can be reversibly fixed to the body 530 using such fixation elements as at least one pin 710 and/or at least one second fixing element 730 (such as a c-member). Being reversibly fixed advantageously allows easy replacement of the second cam 42 if and when the second cam 42 becomes worn. However, in some embodiments, it may be useful to permanently fix the second cam 42 to the body 530. In such embodiments, the second cam 42 can be friction (or cold) welded to the body 530, or the second cam 42 can be hot-welded to the body 530, or the second cam 42 can be formed integrally with the body 530 (either through casting or machining). In yet other embodiments, the second cam 42 can be permanently fixed to the body 530 using one or more of glues, epoxies, or cements.

Certain embodiments described herein advantageously provide methods for remotely coupling a directional drilling tool having a first sensor module to a second sensor module while within a wellbore. These methods advantageously use complementary mating elements to automatically align the first sensor module and the second sensor module in a predetermined orientation.

Figure 9:
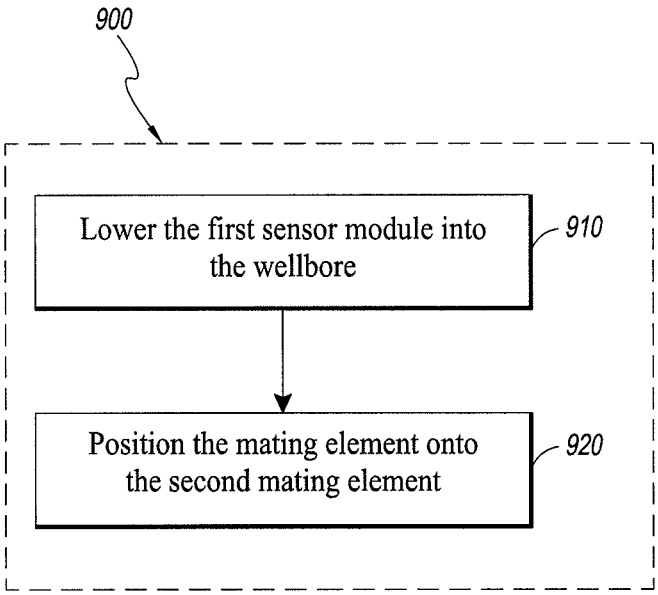
FIG. 9 is a flow chart of a method for steering a directional drilling system in accordance with certain embodiments described herein.
Figure 10:
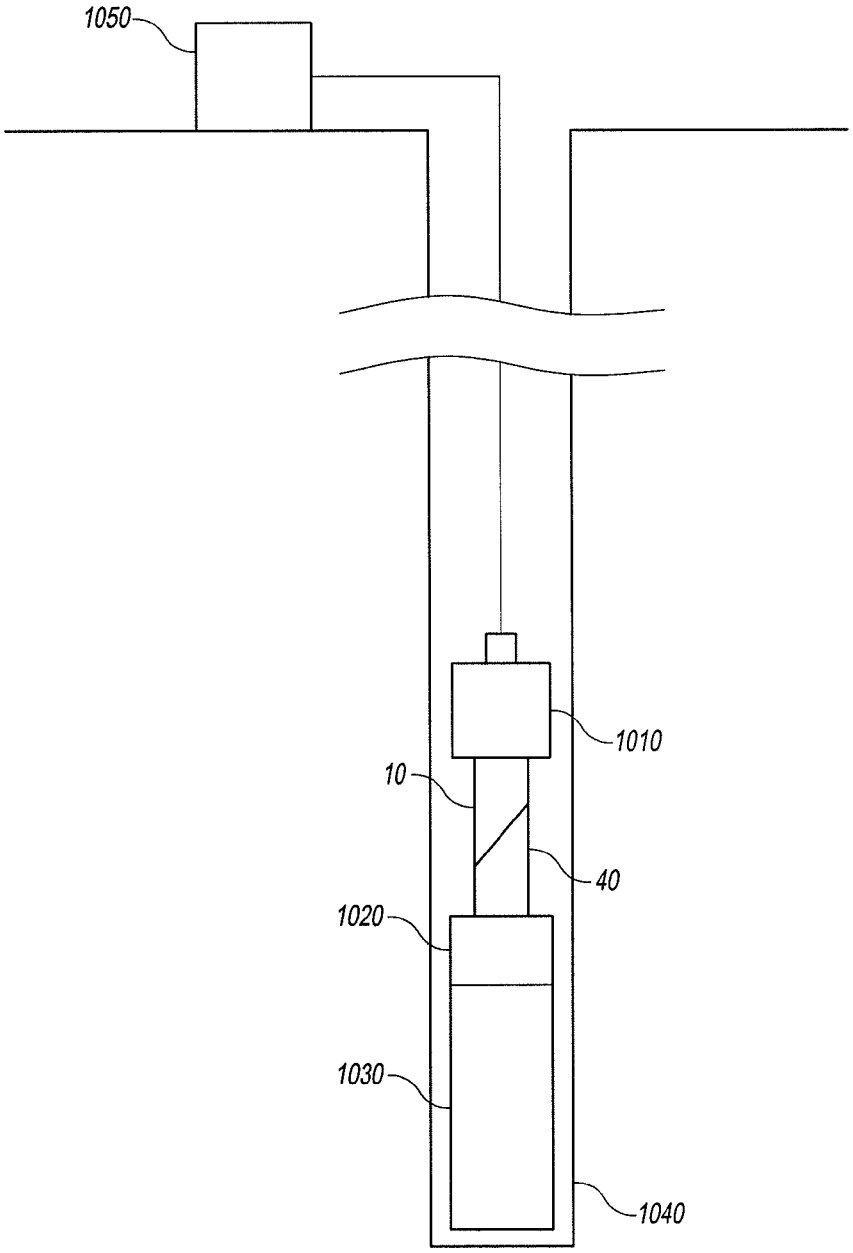
FIG. 10 schematically illustrates an example environment in which the method of FIG. 9 can be practiced in accordance with certain embodiments described herein.

FIG. 9 is a flowchart of an example method 900 for remotely coupling a first sensor module 1010 to a second sensor module 1020 of a directional drilling tool 1030 within a wellbore 1040 in accordance with certain embodiments described herein. FIG. 10 schematically illustrates an example environment in which the method 900 can be practiced in accordance with certain embodiments described herein. While the method 900 is described by referencing the structure of FIG. 10 and the structures of the mating element 10 and the second mating element 40 described above, the method 900 can be performed using other structures as well. In an operational block 910, the method 900 comprises lowering the first sensor module 1010 into the wellbore 1040, the first sensor module 1010 comprising a mating element 10 configured to mate with a second mating element 40 of the directional drilling tool 1030. The mating element 10 comprises a sheath 20 comprising a first cam 22 and an axis 24, and a shroud 30 disposed around the first cam 22. The second mating element 40 comprises a second cam 42 complementary to the first cam 22. In an operational block 920, the method 900 further comprises positioning the mating element 10 onto the second mating element 40 such that the sheath 20 surrounds at least a portion of the second mating element 40 and the first cam 22 seats against the second cam 42 with a predefined orientation about the axis 24.

A directional drilling tool 1030 can be any drilling tool capable of responding to signals to change or alter the direction of drilling by the drilling tool. Examples of a directional drilling tool 1030 compatible with certain embodiments described herein include, but are not limited to, a rotary steerable drilling tool which allows for directional drilling of wellbores while allowing or maintaining rotation of the drill string. Such directional drilling tools include steering mechanisms that enable controlled changes in wellbore direction. Examples of steering mechanisms include, but are not limited to, expandable ribs or pads located around the drilling tool which can be actuated to apply a force on the wellbore walls so as to direct the drilling tool in a desired direction, or steering subsystems configured to angulate a rotatable shaft of the drill string.

The first sensor module 1010 and the second sensor module 1020 can be any drill sensor module, system, or package configured to sense one or more parameters indicative of the position, orientation, or status of a directional drilling system comprising the sensor module. Examples include, but are not limited to, a gyroscope sensor module and an MWD sensor module. In certain embodiments, the second sensor module 1020 is mechanically coupled to the directional drilling tool 1030. For example, the second sensor module 1020 can comprise an MWD sensor module that is part of the directional drill string, and the first sensor module 1010 can comprise a gyroscope sensor module to be attached to the directional drill string.

As described above, the mating element 10 and the second mating element 40 can be mechanically complementary to one another and configured to be attached to one another automatically and remotely while within the wellbore 1040. For example the mating element 10 can comprise the sheath 20 comprising the first cam 22, and the shroud 30 disposed around the first cam 22, and the second mating element 40 can comprise an elongate member 500 and the second cam 42 that is a reciprocal cam to the first cam 22 of the mating element 10. In addition, the mating element 10 can comprise other features as described above in relation to FIGS. 1-5, and the second mating element 40 can comprise other features as described above in relation to FIGS. 6-8.

The mating element 10 can be fixed in a predefined orientation with respect to the one or more sensors of the first sensor module 1010. For example, the mating element 10 can be fixed rotationally to the other portions of the first sensor module 1010. In some embodiments, it can be advantageous to calibrate the first sensor module 1010 prior to insertion of the mating element 10 into the wellbore 1040. In such embodiments, the position of the first sensor module's high-side, or reference direction, can be recorded with respect to the mating element 10 (e.g., relative to the first cam 22). The second mating element 40 can be fixed in a predefined orientation with respect to the one or more sensors of the second sensor module 1020. For example, the second mating element 40 can be fixed rotationally to the other portions of the second sensor module 1020. In some embodiments, it can be advantageous to calibrate the second sensor module 1020 either before or after attachment of the second mating element 40 to the directional drilling tool 1030, but generally prior to insertion of the directional drilling tool 1030 and the second mating element 40 into the wellbore 1040. In such embodiments, the position of the second sensor module's high-side, or reference direction, can be recorded with respect to the second mating element 40 (e.g., relative to the second cam 42 of the second mating element 40). As is discussed further below, such calibrations can allow a user to know the high side position of the first sensor module 1010 with respect to the high side position of the second sensor module 1020 once the mating element 10 and the second mating element 40 are coupled together.

In the operational block 910, lowering the first sensor module 1010 into the wellbore 1040 can comprise lowering the mating element 10 towards the second mating element 40 of the directional drilling tool 1030 within the wellbore 1040. The mating element 10 can be lowered into the wellbore 1040, for example, by using a wireline lowering system or any other device or system configured to controllably lower the first sensor module 1010 down the wellbore 1040. Gravity can pull the first sensor module 1010 down into the wellbore 1040 until the mating element 10 nears the second mating element 40. In certain embodiments, the device or system is further configured to raise the first sensor module 1010 from the directional drilling tool 1030 and the second mating element 40 while allowing the directional drilling tool 1030 to remain within the wellbore 1040.

In the operational block 920, positioning the mating element 10 onto the second mating element 40 comprises attaching the mating element 10 with the second mating element 40. Upon attaching the mating element 10 and the second mating element 40 together, the first cam 22 and the second cam 42 can seat against each other and prevent rotation of the mating element 10 with respect to the second mating element 40, thereby rotationally fixing the first sensor module 1010 with respect to the second sensor module 1020.

For example, the elongate member 500 of the second mating element 40 can be pointing in a generally upward fashion towards the wellbore 1040 opening. As the mating element 10 is lowered, the shroud 30 of the mating element 10 will tend to accept the head 510 of the elongate member 500 and guide it toward the socket 140. Gravity will pull the mating element 10 down even further causing the first cam 22 to engage with (e.g., contact) the second cam 42. As gravity pulls the mating element 10 down onto the second mating element 40, the angled shoulders of the first cam 22 (e.g., first shoulder 120 and second shoulder 122) and the angled shoulders of the second cam 42 (e.g., first shoulder 620 and second shoulder 622) can cause the mating element 10 and second mating element 40 to rotate with respect to each other. The mating element 10 and second mating element 40 can continue to rotate with respect to each other as gravity pulls the mating element 10 down onto the second mating element 40 until the first cam 22 seats fully against the second cam 42. Once the first cam 22 seats fully against the second cam 42, the mating element 10 is advantageously rotationally fixed with respect to the second mating element 40 in a predefined orientation.

Generally, the elongate member 500 of the second mating element 40 can be accepted by and slide into the shroud socket 380 and then into the socket 140 of the mating element 10. The socket 140 can be of sufficient length to accommodate the entire length of the elongate member 500 of the second mating element 40. The entrance of the elongate member 500 into the socket 140 can cause the first cam 22 to contact the second cam 42.

In certain embodiments, when the first cam 22 contacts the second cam 42, the cam point 110 of the first cam 22 can slide along the first shoulder 620 or second shoulder 622 of the second cam 42 and the cam point 610 of the second cam 42 can slide along the first shoulder 120 or second shoulder 122 of the first cam 22. The body 530 in the socket 140 can hold the mating element 10 and second mating element 40 axially stable with respect to each other. Therefore, as the first cam 22 and the second cam 42 slide toward each other, they can cause the mating element 10 and the second mating element 40 to rotate until the cam point 610 of the second cam 42 arrives at the notch 130 of the first cam 22 and the cam point 110 of the first cam 22 arrives at the notch 630 of the second cam 42. The first shoulder 120 of the first cam 22 then seats against the reciprocal second shoulder 622 of the second cam 42 and the second shoulder 122 of the first cam 22 seats against the reciprocal first shoulder 620 of the second cam 42. Therefore, the first cam 22 and the second cam 42 can fully seat against each other in a stable fashion.

Due to the cam point 110 of the mating element 10 and its advantageous radius of curvature 111, and the cam point 610 of the second mating element 40 and its advantageous radius of curvature 611, it is unlikely that the mating element 10 and the second mating element 40 will bind against each other. For example, the radii of curvature 111, 611 of the cam point 110 and the cam point 610 can be sufficiently small such that, even if they were to meet head on, the two cam points 110, 610 would generally slide against each other, thereby allowing the mating element 10 and the second mating element 40 to rotate into the correct, pre-defined alignment.

Upon full seating of the first cam 22 against the second cam 42, the mating element 10 can reproducibly be in the same rotational position about its longitudinal axis with respect to the second mating element 40. By extension, the second mating element 40 can also reproducibly be in the same rotational position about its longitudinal axis with respect to the mating element 10. Since the mating element 10 has a predefined orientation with regard to the one or more sensors of the first sensor module 1010 and the second mating element 40 has a predefined orientation with regard to the one or more sensors of the second sensor module 1020, the resultant combined structure provides a known and predefined orientation between the sensors of the first sensor module 1010 and the second sensor module 1020. This system can be used for alignment of sensitive measurement sensors under the surface of the earth. It is advantageous that the mating element 10 and second mating element 40 can align in the same or predefined rotational orientation without any input from a user. The calibration, mentioned above, of the first sensor module 1010 with respect to the first cam 22 and the calibration of the second sensor module 1020 with respect to the second cam 42 can advantageously allow a user to know the position of the first sensor module 1010 with respect to the second sensor module 1020 without any guidance or input from the user (including when the entire system is far down-hole in a wellbore 1040).

The shroud 30 of the mating element 10 provides a further benefit by further decreasing the possibility of unintended binding of the first sensor module 1010 in an unknown orientation relative to the second sensor module 1020. The shroud 30 uses the shroud socket 380 to guide the head 510 of the second mating element 40 uniformly and consistently into the socket 140 of the mating element 10. An unintended bind (i.e., a locking of the sensors in a false alignment) would produce false data and since the system is operated underground, a user cannot know when the system is misaligned due to a bind, and the data is false. Therefore, when a second sensor module 1020 is rotationally fixed to the second mating element 40 and a first sensor module 1010 is rotationally fixed to the mating element 10, the second mating element 40 and mating element 10 can be used to rotationally align the first sensor module 1010 and the second sensor module 1020 (even with no user involvement) through automatic alignment and seating of the first cam 22 and second cam 42. The pin 710 and the body 530 can provide axial stability to the entire system keeping it fixed once the two cams mate and seat. In certain embodiments, once the mating element 10 and the second mating element 40 are mechanically coupled to one another, the first sensor module 1010 and the second sensor module 1020 can be used to generate signals indicative of the position, orientation, or status of the directional drilling tool 1030. These signals can be received by a processor 1050 to control the steering mechanism of the directional drilling tool 1030. In some embodiments, the signals are transmitted wirelessly from the first and second sensor modules 1010, 1020 to the processor 1050 (e.g., using a wireless network), while in other embodiments, the signals are transmitted through at least one wired connection.

In some embodiments, the first sensor module 1010 and the second sensor module 1020 are each turned on prior to being inserted into the wellbore 1040. In other embodiments, the first sensor module 1010 and the second sensor module 1020 are turned on remotely. However, until the first sensor module 1010 and the second sensor module 1020 are in a rotationally predefined orientation with respect to each other, the data resulting from signals generated by the first sensor module 1010 are not considered to be correlated with data resulting from the signals generated by the second sensor module 1020. The data received by a user from the gyroscope sensor module and the MWD sensor module becomes increasingly useful as the first and second sensor modules 1010, 1020 are both aligned in a pre-determined orientation (such as having both of their high-sides aligned). Therefore, it is advantageous to wait until the mating element 10 and the second mating element 40 have mated and are seated and aligned with one another. At that time, at least one signal produced by at least one of the first sensor module 1010 and at least one signal produced by the second sensor module 1020 can be received.

Upon receiving the at least one signal from the first sensor module 1010 and/or the second sensor module 1020, a user can use that at least one signal to steer the directional drilling tool 1030. In operation, the first sensor module 1010 and the second sensor module 1020 can provide positional and movement data to a user. Therefore, the user may use the at least one signal to determine, among other things, the positional characteristics of the directional drilling tool 1030 (e.g., position, speed, angle, etc.). The positional characteristics can be used to steer the directional drilling tool 1030. For example, if the rotationally aligned first and second sensor modules 1010, 1020 indicate that the directional drilling tool 1030 is deviating off the intended path, the user can steer the directional drilling tool 1030 in response to that information until it is back on its intended path.

In some embodiments, the head 510 of the elongate member 500 can be used to remove the second mating element 40 and anything connected thereto, such as a second sensor module 1020 and/or a directional drilling tool 1030. In some embodiments, the first mating element 10 can include a latch (not shown) on the inside of the socket 140 that "snaps" into place over the head 510 of the elongate member 500 upon full seating of the first cam 22 against the second cam 42. Such a latch can be used to hold the first mating element 10 to the second mating element 40 so that the first mating element 10 and the second mating element 40 can be withdrawn from a wellbore 1040 together using the wireline on which the first mating element 10 was lowered onto the second mating element 40. In some embodiments, the first mating element 10 does not include a latch and can be withdrawn from the wellbore 1040 without removing the second mating element 40.

In some embodiments, a latching mechanism (not shown) that is entirely separate from a first mating element 10, can be lowered down into the wellbore 1040, for example, by using a wireline lowering system or any other device or system configured to controllably lower the latching mechanism down the wellbore 1040. Gravity can pull the latching mechanism down into the wellbore 1040 until latching mechanism nears the head 510 of the second mating element 40. In certain embodiments, the latching mechanism can settle down onto the head 510 and latch in place over the head 510. The wireline to which the latching mechanism is attached and on which the latching mechanism was lowered onto the second mating element 40 can be used to withdraw the latching mechanism after it has latched onto to the head 510, thereby also withdrawing the second mating element 40 and anything connected thereto, such as a second sensor module 1020 and/or a directional drilling tool 1030.

The at least one processor 1050 can comprise one or more micro-processors or other computer configured to receive the signals from the first and second sensor modules 1010, 1020 and to generate control signals to be transmitted to the steering mechanism of the directional drilling tool 1030. The at least one processor 1050 can be further configured to determine a position, an orientation, and/or a status of the directional drilling tool 1030 in response to the signals from the first and second sensor modules 1010, 1020. The at least one processor 1050 can comprise one or more hardware processors in communication with at least one computer-readable memory that stores software modules including instructions that are executable by the one or more hardware processors. The software modules can include one or more software modules configured to receive the signals from the first and second sensor modules 1010, 1020 and to use the signals to calculate the position, the orientation, and/or the status of the directional drilling tool 1030. In certain embodiments, a non-transitory computer storage can be provided having stored thereon a computer program that instructs a computer system (e.g., the at least one processor 1050) in accordance with certain embodiments described herein. In certain embodiments, the at least one processor 1050 is part of a controller generally configured to control and/or monitor the operation of the directional drilling tool 1030 or portions thereof, with the controller comprising hardware, software, or a combination of both hardware and software. The at least one processor 1050 can further be configured to communicate with a memory subsystem configured to store appropriate information, such as orientation data, data obtained from one or more of the first and second sensor modules 1010, 1020. In certain embodiments, the at least one processor 1050 provides a real-time processing analysis of the signals or data obtained from the first and second sensor modules 1010, 1020. In certain embodiments, the at least one processor 1050 is located at or above the Earth's surface (e.g., as schematically illustrated by FIG. 10), or is located within the directional drilling tool 1030 within the wellbore 1040. In some embodiments, a portion of the at least one processor 1050 is located at or above the Earth's surface, and another portion of the at least one processor 1050 is located within the wellbore 1040 and is communicatively coupled to the portion at or above the Earth's surface.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Depending on the embodiment, certain acts, events, or functions of any of the methods described herein can be performed in a different sequence, can be added, merged, or left out completely (e.g., not all described acts or events are necessary for the practice of the method). Moreover, in certain embodiments, acts or events can be performed concurrently, rather than sequentially.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments described herein can be embodied within a form that does not provide all of the features and benefits set forth herein, as some features can be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. A system for the down-hole alignment of a mating element and a second mating element, the system comprising:

a mating element, comprising:

a sheath comprising an axis and a first cam, the first cam having a first cam point and a first notch; and a shroud disposed around the first cam and extending past the first cam point;

a second mating element, comprising:

an elongate member;

a second cam releasably mounted around the elongate member, the second cam having a second cam point and a second notch; and a pin releasably disposed through the elongate member and the second cam, the pin having a length greater than an outer diameter of the second cam;

the first mating element configured to mate with the second mating element such that the sheath accepts the elongate member, and the first cam seats against the second cam with a predefined orientation about the axis, the second notch accepting the first cam point and the first notch accepting the second cam point.

2. The system of claim 1, wherein the first cam point has a first radius of curvature and the second cam point has a second radius of curvature, the first radius of curvature being substantially equal to the second radius of curvature.

3. The system of claim 2, wherein the first radius of curvature is substantially equal to 1/100 of an inch.

4. The system of claim 1, wherein the first cam has a first angle and the second cam has a second angle, the first angle being substantially equal to the second angle.

5. The system of claim 1, wherein the first cam has a first shoulder and the second cam has a second shoulder, the first shoulder being complementary to the second shoulder.

6. The system of claim 5, wherein at least a portion of the first shoulder has a first flat face and a complementary portion of the second shoulder has a second flat face, such that when the first cam seats against the second cam, the first flat face seats against the second flat face.

7. The system of claim 1, wherein the shroud has a first socket portion having a first inner diameter and a second socket portion having second inner diameter, the first inner diameter being substantially equal to an outer diameter of the first cam and the second inner diameter being larger than the length of the pin, the second portion configured to accept the pin.

8. The system of claim 1, wherein the mating element is configured to releasably attach to at least one of a measurement while drilling device and a gyroscope.

9. The system of claim 1, wherein the mating element further comprises at least one of a measurement while drilling device and a gyroscope.

10. The system of claim 1, wherein the second mating element is configured to releasably attach to at least one of a measurement while drilling device and a gyroscope.

11. The system of claim 1, wherein the second mating element further comprises at least one of a measurement while drilling device and a gyroscope.

12. A method for remotely coupling a first sensor module to a second sensor module of a directional drilling tool within a wellbore, the method comprising:

lowering the first sensor module into the wellbore, the first sensor module comprising a mating element configured to mate with a second mating element of the directional drilling tool, the mating element comprising:

a sheath comprising a first cam and an axis; and a shroud disposed around the first cam, wherein the second mating element comprises a second cam complementary to the first cam; and positioning the mating element onto the second mating element such that the sheath surrounds at least a portion of the second mating element and the first cam seats against the second cam with a predefined orientation about the axis.

13. A mating element configured to mate to a second mating element while the mating element and the second mating element are within a wellbore, the mating element comprising:

a sheath comprising a first cam and an axis; and a shroud disposed around the first cam;

wherein:

the second mating element comprises a second cam complementary to the first cam;

the first cam comprises a first point having a first radius of curvature and the second cam comprises a second point having a second radius of curvature; and upon mating, the sheath surrounds at least a portion of the second mating element and the first cam seats against the second cam with a predefined orientation about the axis.

14. The mating element of claim 13, wherein the shroud extends past an end of the first cam.

15. The mating element of claim 14, wherein the shroud is configured to guide the second mating element into the first cam.

16. The mating element of claim 13, wherein the first radius of curvature is substantially equal to the second radius of curvature.

17. The mating element of claim 13, wherein the first cam has a first angle and the second cam has a second angle, the first angle being substantially equal to the second angle.

18. The mating element of claim 13, wherein the first cam has a first shoulder and the second cam has a second shoulder, the first shoulder being complementary to the second cam shoulder.

19. The mating element of claim 18, wherein at least a portion of the first shoulder has a first flat face and a complementary portion of the second shoulder has a second flat face, such that when the first cam seats against the second cam, the first flat face seats against the second flat face.

20. The mating element of claim 13, wherein the mating element is configured to releasably attach to at least one of a measurement while drilling device and a gyroscope.

21. The mating element of claim 13, wherein the second mating element is configured to releasably attach to at least one of a measurement while drilling device and a gyroscope.

22. The mating element of claim 13, wherein the second mating element further comprises at least one of a measurement while drilling device and a gyroscope.

23. A mating element configured to mate to a second mating element while the mating element and the second mating element are within a wellbore, the mating element comprising:

a sheath comprising a first cam and an axis; and a shroud disposed around the first cam;

wherein:

the second mating element comprises a second cam complementary to the first cam;

the second cam is reversibly attached to the second mating element; and upon mating, the sheath surrounds at least a portion of the second mating element and the first cam seats against the second cam with a predefined orientation about the axis.

24. A mating element configured to mate to a second mating element while the mating element and the second mating element are within a wellbore, the mating element comprising:

a sheath comprising a first cam and an axis; and a shroud disposed around the first cam;

wherein:

the mating element further comprises at least one of a measurement while drilling device and a gyroscope;

the second mating element comprises a second cam complementary to the first cam; and upon mating, the sheath surrounds at least a portion of the second mating element and the first cam seats against the second cam with a predefined orientation about the axis.

* * * * *